US010843468B2

(12) United States Patent
Nakagawa et al.

(10) Patent No.: US 10,843,468 B2
(45) Date of Patent: Nov. 24, 2020

(54) INKJET PRINTING APPARATUS AND RECOVERY METHOD

(71) Applicant: CANON KABUSHIKI KAISHA, Tokyo (JP)

(72) Inventors: Yoshinori Nakagawa, Kawasaki (JP); Takatoshi Nakano, Yokohama (JP); Atsushi Takahashi, Tama (JP); Takuya Fukasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/564,485

(22) Filed: Sep. 9, 2019

(65) Prior Publication Data

US 2020/0108612 A1 Apr. 9, 2020

(30) Foreign Application Priority Data

Oct. 5, 2018 (JP) ..... 2018-189658

(51) Int. Cl.
*B41J 2/165* (2006.01)
*B41J 2/21* (2006.01)

(52) U.S. Cl.
CPC ..... *B41J 2/16535* (2013.01); *B41J 2/16511* (2013.01); *B41J 2/2114* (2013.01)

(58) Field of Classification Search
CPC ..... B41J 2/14; B41J 2/16511; B41J 2/16517; B41J 2/16535; B41J 2/16538; B41J 2/16588; B41J 2/18; B41J 2/2114; B41J 29/02; B41J 29/38; B41J 2002/16573
See application file for complete search history.

(56) References Cited

U.S. PATENT DOCUMENTS

| | | | |
|---|---|---|---|
| 6,984,009 B2 | 1/2006 | Nakagawa et al. | |
| 6,994,416 B2 | 2/2006 | Seki et al. | |
| 7,144,096 B2 | 12/2006 | Seki et al. | |
| 7,896,463 B2 | 3/2011 | Nakagawa et al. | |
| 8,752,930 B2 | 6/2014 | Doi et al. | |
| 8,827,419 B2 | 9/2014 | Nakagawa et al. | |
| 8,944,562 B2 | 2/2015 | Nakagawa et al. | |
| 9,096,065 B2 | 8/2015 | Nakano et al. | |
| 10,265,951 B2 | 4/2019 | Nakano et al. | |
| 10,350,895 B2 * | 7/2019 | Tanioku | B41J 2/16538 |
| 10,427,410 B2 | 10/2019 | Nakagawa et al. | |
| 10,442,191 B2 | 10/2019 | Takahashi et al. | |
| 10,493,762 B2 | 12/2019 | Sato et al. | |

(Continued)

FOREIGN PATENT DOCUMENTS

JP S64-71758 A 3/1989

*Primary Examiner* — Anh T Vo
(74) *Attorney, Agent, or Firm* — Venable LLP

(57) ABSTRACT

Provided is an inkjet printing apparatus and recovery method capable of executing wiping according to the state of ink attached to the ejection opening surface. The inkjet printing apparatus includes: a printing unit to perform printing by ejecting ink from ejection openings; a wiping unit to perform first wiping for an ejection opening surface having the ejection openings and to perform second wiping having higher performance of removing ink from the ejection opening surface than the first wiping; and an obtaining unit to obtain information on a temperature of the ejection opening surface. The control unit, based on the information, causes the wiping unit to perform the first wiping or the second wiping.

21 Claims, 14 Drawing Sheets

(56) References Cited

U.S. PATENT DOCUMENTS

| | | | | |
|---|---|---|---|---|
| 2004/0041862 | A1 | 3/2004 | Nakagawa et al. | |
| 2010/0231634 | A1* | 9/2010 | Yokota | B41J 2/16538 347/17 |
| 2011/0074870 | A1* | 3/2011 | Maida | B08B 9/00 347/28 |
| 2013/0328954 | A1* | 12/2013 | Fukuda | B41J 2/04588 347/10 |
| 2019/0001670 | A1 | 1/2019 | Fukasawa et al. | |
| 2019/0009522 | A1 | 1/2019 | Fukasawa et al. | |
| 2019/0009553 | A1 | 1/2019 | Nakai et al. | |
| 2019/0009590 | A1 | 1/2019 | Fukasawa et al. | |
| 2020/0108610 | A1 | 4/2020 | Kiuchi et al. | |
| 2020/0108611 | A1 | 4/2020 | Nakagawa et al. | |
| 2020/0108616 | A1 | 4/2020 | Nakagawa et al. | |
| 2020/0108626 | A1 | 4/2020 | Fukasawa et al. | |

* cited by examiner

INKJET PRINTING APPARATUS AND RECOVERY METHOD

BACKGROUND OF THE INVENTION

Field of the Invention

The present invention relates to inkjet printing apparatuses that eject ink onto print media to perform printing and recovery methods for keeping favorable the condition of ink ejection from the print head which ejects ink and also recovering it.

Description of the Related Art

Japanese Patent Laid-Open No. S64-71758 discloses a technique in which the number of ink ejections (the number of dots) is counted, and in the case where the count value exceeds a specified value, wiping is performed with a blade on the ejection opening surface on which ejection openings for ejecting ink are formed. In the technique disclosed in Japanese Patent Laid-Open No. S64-71758, the degree of wet which indicates the state of ink attached to the ejection opening surface due to rebounding of ink ejected onto print media or other factors is estimated from the count value of the number of dots. In the case where it is determined that there is a possibility that a high degree of wet has occurred on the ejection opening surface, wiping is performed to remove the wet on the ejection opening surface.

Meanwhile, the print head is heated such that its temperature is controlled to be within a specified range in order to make ink ejection stable. Hence the ink attached to the ejection opening surface may thicken and solidify on the ejection opening surface. The ink solidified on the ejection opening surface may not be removed by wiping with the blade and may remain on the ejection opening surface.

SUMMARY OF THE INVENTION

The present invention provides an inkjet printing apparatus and recovery method capable of executing wiping according to the state of ink attached to the ejection opening surface.

In the first aspect of the present invention, there is provided an inkjet printing apparatus including:

a printing unit including a member provided with ejection opening surface formed on arrayed multiple ejection openings configured to perform printing by ejecting ink from the ejection openings;

a wiping unit configured to wipe the ejection opening surface using wiping member and further configured to perform first wiping in which wiping is performed on the ejection opening surface and to perform second wiping having higher performance of removing ink from the ejection opening surface than the first wiping;

an obtaining unit configured to obtain information on a temperature of the ejection opening surface;

a control unit configured to control the wiping unit based on the information obtained by the obtaining unit such that in a case where a value indicated by the information is less than a specified value, the control unit causes the wiping unit to perform the first wiping, and in a case where the value indicated by the information is the specified value or more, the control unit causes the wiping unit to perform the second wiping.

In the second aspect of the present invention, there is provided a recovery method used in an inkjet printing apparatus including a printing unit provided with an ejection opening surface formed on arrayed multiple ejection openings and configured to perform printing by ejecting ink from the arrayed multiple ejection openings, the recovery method being for maintaining and recovering ejection performance of the ejection openings including: a obtaining step of obtaining information on a temperature of the ejection opening surface, and a wiping step of wiping the ejection opening surface based on the information obtained in the obtaining, in a case where a value indicated by the information is less than a specified value, the first wiping is performed, and in a case where the value indicated by the information is the specified value or more, the second wiping having higher performance of removing ink from the ejection opening surface than the first wiping.

The present invention makes it possible to execute wiping according to the state of ink attached to the ejection opening surface.

Further features of the present invention will become apparent from the following description of exemplary embodiments with reference to the attached drawings.

DESCRIPTION OF THE EMBODIMENTS

Hereinafter, embodiments of the present invention will be described in detail with reference to the drawings. The following embodiments are not intended to limit the present invention, and all the combinations of the features described in the present embodiment are not necessarily essential for the solutions in the present invention. Note that relative positions, shapes, and the like of the constituents described in the embodiments are mere examples and hence not intended to limit the scope of the invention to only those.

Figure 1:
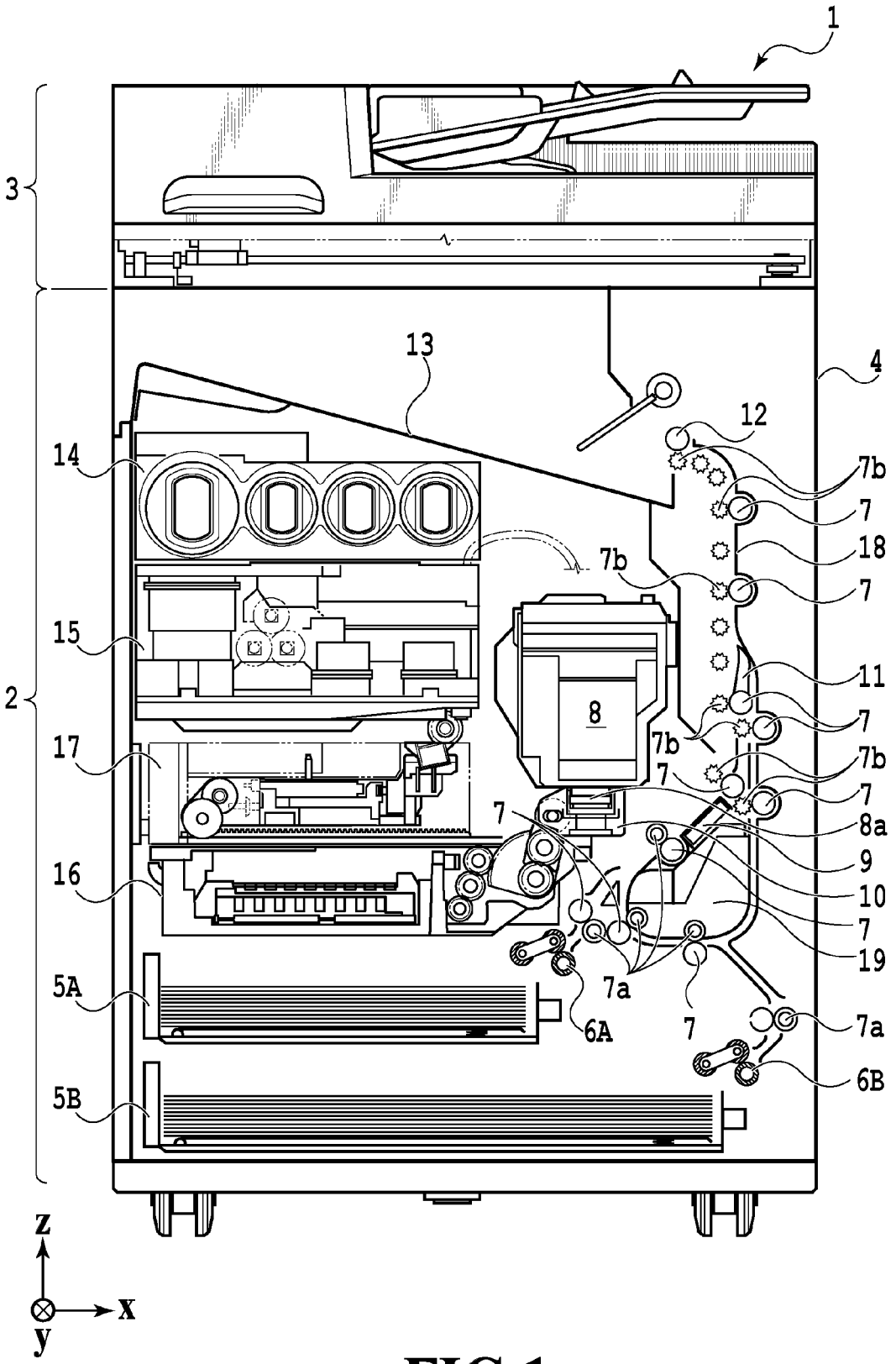
FIG. 1 is a view of a printing apparatus in a standby state.

FIG. 1 is a view of the internal configuration of an inkjet printing apparatus 1 (hereinafter, the printing apparatus 1) used in this embodiment. In FIG. 1, an x direction represents a horizontal direction, a y direction (direction normal to the sheet surface) represents a direction in which ejection ports are aligned in a later-described print head 8, and a z direction represents the vertical direction.

The printing apparatus 1 is a multifunction printer including a print unit 2 and a scanner unit 3. The printing apparatus 1 can use the print unit 2 and the scanner unit 3 separately or in synchronization to perform various processes related to print operation and scan operation. The scanner unit 3 includes an automatic document feeder (ADF) and a flatbed scanner (FBS) and is capable of scanning a document automatically fed by the ADF as well as scanning a document placed by a user on a document plate of the FBS. The present embodiment is directed to the multifunction printer including both the print unit 2 and the scanner unit 3, but the scanner unit 3 may be omitted. FIG. 1 shows the printing apparatus 1 in a standby state in which neither print operation nor scan operation is performed.

A first cassette 5A and a second cassette 5B that house print media (cut sheets) S are mounted in an attachable and detachable manner at a bottom portion of the print section 2 on the lower side of a housing 4 in the vertical direction. The first cassette 5A houses relatively small print media of up to a size of A4 in the form of a flat pile. The second cassette 5B houses relatively large print media of a size of up to A3 in the form of a flat pile. Near the first cassette 5A, a first feed unit 6A is provided which separately feeds the housed print media. Likewise, a second feed unit 6B is provided near the second cassette 5B. When a print operation is performed, a print medium S is fed selectively from one of the cassettes.

Conveying rollers 7, a discharge roller 12, pinch rollers 7*a*, spurs 7*b*, a guide 18, an inner guide 19, and a flapper 11 are conveying mechanisms that guide print media S in predetermined directions. The conveying rollers 7 are drive rollers disposed upstream and downstream of the print head 8 and driven by a conveying motor not illustrated. The pinch rollers 7*a* are driven rollers that rotate while nipping a print medium S with the conveying rollers 7. The discharge roller 12 is a drive roller disposed downstream of the conveying rollers 7 and driven by a conveying motor not illustrated. The spurs 7*b* convey a print medium S while holding it between themselves and the conveying rollers 7 disposed downstream of the print head 8 and the discharge roller 12.

The guide 18 is provided along a conveying path for print media S and guides a print medium S in predetermined directions. The inner guide 19 is a member extending in the y direction and having a curved side surface and guides a print medium S along this side surface. The flapper 11 is a member that switches the direction of conveyance of a print medium S in a double-sided print operation. A discharge tray 13 is a tray on which to place and hold print media S discharged by the discharge roller 12 after completing their print operations.

The print head 8 of in the embodiments is a full-line color inkjet print head, in which the ejection openings capable of ejecting ink according to print data are arrayed along the y-direction of FIG. 1 by the length corresponding to the width of a print medium S. Specifically, the print head 8 is configured to be capable of ejecting ink of multiple colors. In the state in which the print head 8 is at a standby position, the ejection opening surface 8*a* of the print head 8 faces vertically downward and is capped with a cap unit 10 as illustrated in FIG. 1. In print operation, the orientation of the print head 8 is changed by a print controller 202 described later such that the ejection opening surface 8*a* faces a platen 9. The platen 9, composed of a flat plate extending in the y-direction, supports a print medium S from its back surface while the print head 8 is performing print operation on the print medium S. The movement of the print head 8 from the standby position to a printing position will be described later in detail.

An ink tank unit 14 stores inks of four colors to be supplied to the print head 8. An ink supply unit 15 is provided at a point along a flow channel connecting the ink tank unit 14 and the print head 8 and adjusts the pressure and flow rate of the inks inside the print head 8 within appropriate ranges. This embodiment employs a circulatory ink feed system. The ink supply unit 15 adjusts the pressure of the inks to be supplied to the print head 8 and the flow rate of the inks collected from the print head 8 within appropriate ranges.

A maintenance unit 16 includes the cap unit 10 and a wiping unit 17 and operates them with a predetermined timing to perform a maintenance operation on the print head 8. The maintenance operation will be described later in detail.

Figure 2:
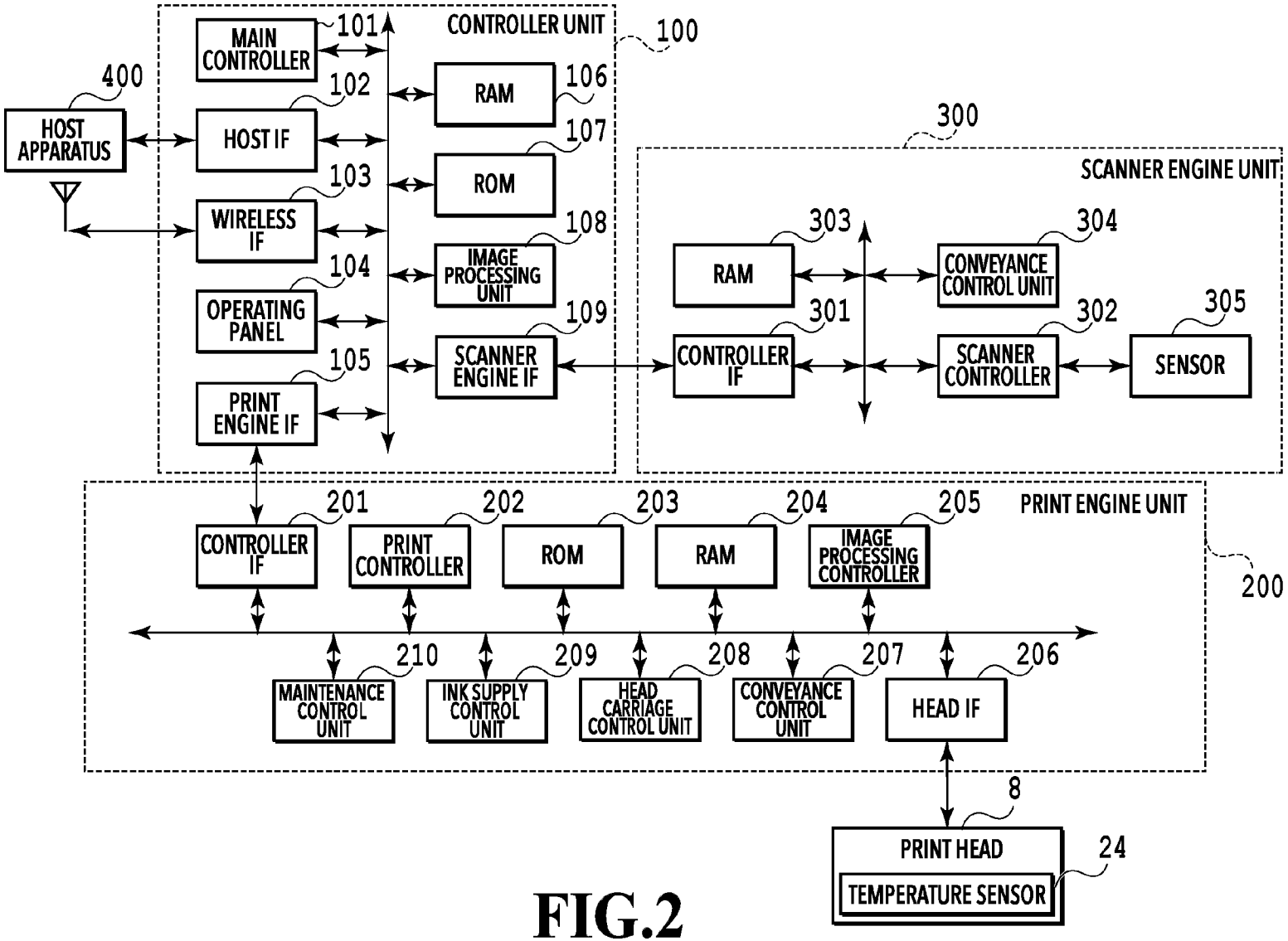
FIG. 2 is a diagram of a control configuration of the printing apparatus.

FIG. 2 is a block diagram illustrating a control configuration in the printing apparatus 1. The control configuration mainly includes a print engine unit 200 that controls the print section 2, a scanner engine unit 300 that controls the scanner section 3, and a controller unit 100 that controls the whole printing apparatus 1. The print controller 202 controls various mechanisms of the print engine unit 200 in accordance with instructions from a main controller 101 of the controller unit 100. Various mechanisms of the scanner engine unit 300 are controlled by the main controller 101 of the controller unit 100. Details of the control configuration will be described below.

In the controller unit 100, the main controller 101, configured of a CPU, controls the entire printing apparatus 1 by using an RAM 106 as a work area in accordance with programs and various parameters stored in an ROM 107. For example, upon input of a print job from a host apparatus 400 through a host I/F 102 or a wireless I/F 103, an image processing unit 108 performs predetermined image processing on received image data in accordance with an instruction from the main controller 101. The main controller 101 then transmits the image data after the image processing to the print engine unit 200 through a print engine I/F 105.

Meanwhile, the printing apparatus 1 may obtain image data from the host apparatus 400 by means of wireless communication or wired communication or from an external storage device (such as a USB memory) connected to the printing apparatus 1. The communication method used for the wireless communication or the wired communication is not particularly limited. For example, Wireless Fidelity (Wi-Fi) (registered trademark) or Bluetooth (registered trademark) can be employed as the communication method used for the wireless communication. Also, universal serial bus (USB) or the like can be employed as the communication method used for the wired communication. Further, for example, upon input of a read command from the host apparatus 400, the main controller 101 transmits this command to the scanner section 3 through a scanner engine I/F 109.

An operating panel 104 is a mechanism with which the user inputs and receives information into and from the printing apparatus 1. Through the operating panel 104, the user can instruct the controller unit 100 to perform operations such as photocopying and scanning, set a print mode, check information on the printing apparatus 1, and so on.

In the print engine unit 200, the print controller 202, configured of a CPU, controls various mechanisms of the print section 2 by using an RAM 204 as a work area in accordance with programs and various parameters stored in an ROM 203. Upon receipt of various commands and image data through a controller I/F 201, the print controller 202 temporarily stores them in an RAM 204. The print controller 202 causes an image processing controller 205 to convert the stored image data into print data so that the print head 8 can use the stored image data in a print operation. After the print data is generated, the print controller 202 causes the print head 8 to perform a print operation based on the print data through a head I/F 206. In doing so, the print controller 202 conveys a print medium S by driving the feed unit 6A or 6B, the conveying rollers 7, the discharge roller 12, and the flapper 11, which are illustrated in FIG. 1, through a conveyance control unit 207. A print process is performed by performing a print operation with the print head 8 in combination with the operation of conveying the print medium S in accordance with instructions from the print controller 202.

A head carriage control unit 208 changes the orientation and position of the print head 8 in accordance with the operation state of the printing apparatus 1 such as a maintenance state or a print state. An ink supply control unit 209 controls the ink supply unit 15 such that the pressure of the inks to be supplied to the print head 8 fall within an appropriate range. A maintenance control unit 210 controls the operation of the cap unit 10 and the wiping unit 17 of the maintenance unit 16 when a maintenance operation is performed on the print head 8.

For the scanner engine unit 300, the main controller 101 controls hardware resources in a scanner controller 302 by using the RAM 106 as a work area in accordance with programs and various parameters stored in the ROM 107. As a result, various mechanisms of the scanner section 3 are controlled. For example, the main controller 101 controls hardware resources in the scanner controller 302 through a controller I/F 301 such that a document loaded on the ADF by the user is conveyed through a conveyance control unit 304 and read by a sensor 305. Then, the scanner controller 302 stores the read image data in an RAM 303. Meanwhile, by converting the image data thus obtained into print data, the print controller 202 can cause the print head 8 to perform a print operation based on the image data read by the scanner controller 302.

Figure 3:
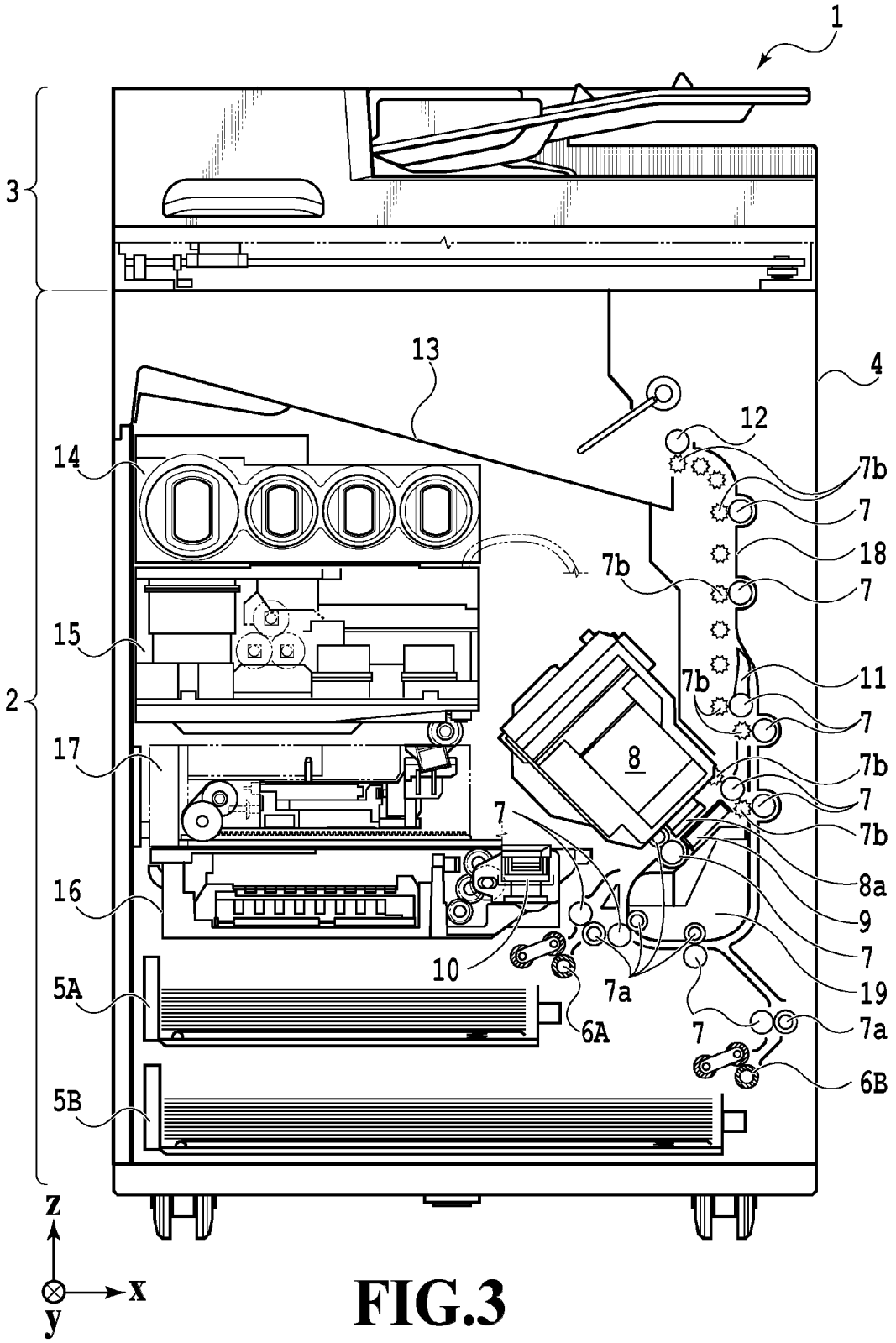
FIG. 3 is a view of the printing apparatus in a print state.

FIG. 3 illustrates the printing apparatus 1 in a print state. In contrast to the standby state illustrated in FIG. 1, the cap unit 10 is separated from the ejection opening surface 8*a* of the print head 8, and the ejection opening surface 8*a* is facing the platen 9. In this embodiment, the plane of the platen 9 is tilted at approximate 45 degrees with respect to the horizontal direction, and the ejection opening surface 8*a* of the print head 8 at the print position is also tilted at approximately 45 degrees with respect to the horizontal direction so that the distance between the ejection opening surface 8*a* and the platen 9 can be kept at a fixed distance.

When the print head 8 is moved from the standby position illustrated in FIG. 1 to the print position illustrated in FIG. 3, the print controller 202 lowers the cap unit 10 to a retreat position illustrated in FIG. 3 by using the maintenance control unit 210. As a result, the ejection opening surface 8*a* of the print head 8 is separated from a cap member 10*a*. Then, using the head carriage control unit 208, the print controller 202 turns the print head 8 by 45 degrees while adjusting its height level in the vertical direction, to thereby cause the ejection opening surface 8*a* to face the platen 9. The print controller 202 performs the reverse of the above steps when moving the print head 8 from the print position to the standby position after a print operation is completed.

Next, the maintenance operation on the print head 8 will be described. As also described with reference to FIG. 1, the maintenance unit 16 in this embodiment includes the cap unit 10 and the wiping unit 17 and operates them with a predetermined timing to perform the maintenance operation.

Figure 4:
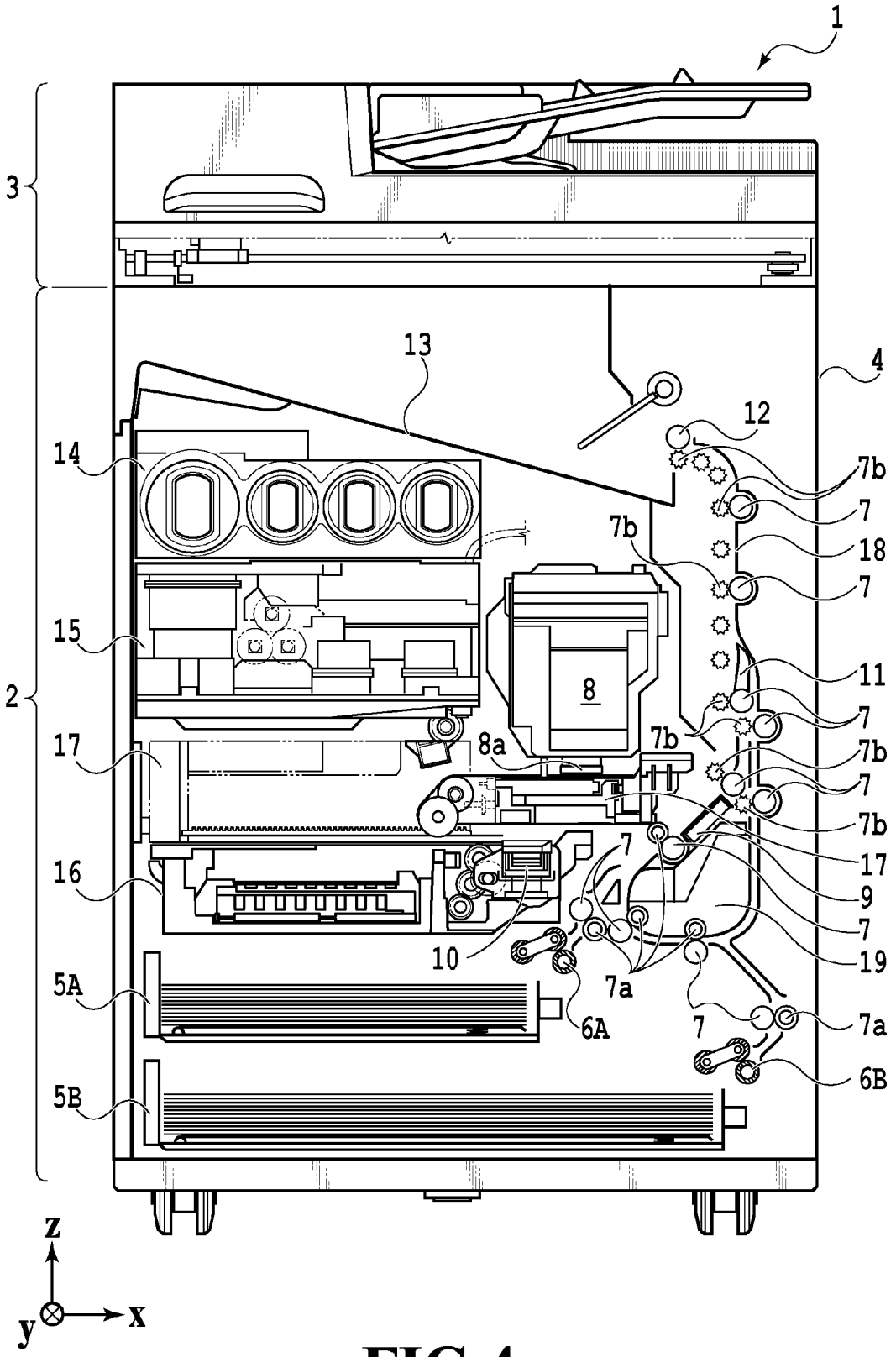
FIG. 4 is a view of the printing apparatus in a maintenance state.

FIG. 4 is a view of the printing apparatus 1 in the maintenance state. To move the print head 8 from the standby position illustrated in FIG. 1 to a maintenance position illustrated in FIG. 4, the print controller 202 moves the print head 8 upward in the vertical direction and moves the cap unit 10 downward in the vertical direction. The print controller 202 then moves the wiping unit 17 in the rightward direction in FIG. 4 from its retreat position. The print controller 202 thereafter moves the print head 8 downward in the vertical direction to thereby move it to the maintenance position, at which the maintenance operation can be performed.

Also, to move the print head 8 from the print position illustrated in FIG. 3 to the maintenance position illustrated in FIG. 4, the print controller 202 moves the print head 8 upward in the vertical direction while turning it by 45 degrees. The print controller 202 then moves the wiping unit 17 in the rightward direction from its retreat position. The print controller 202 thereafter moves the print head 8 downward in the vertical direction to thereby move it to the maintenance position, at which the maintenance operation by the maintenance unit 16 can be performed.

Figure 5A:
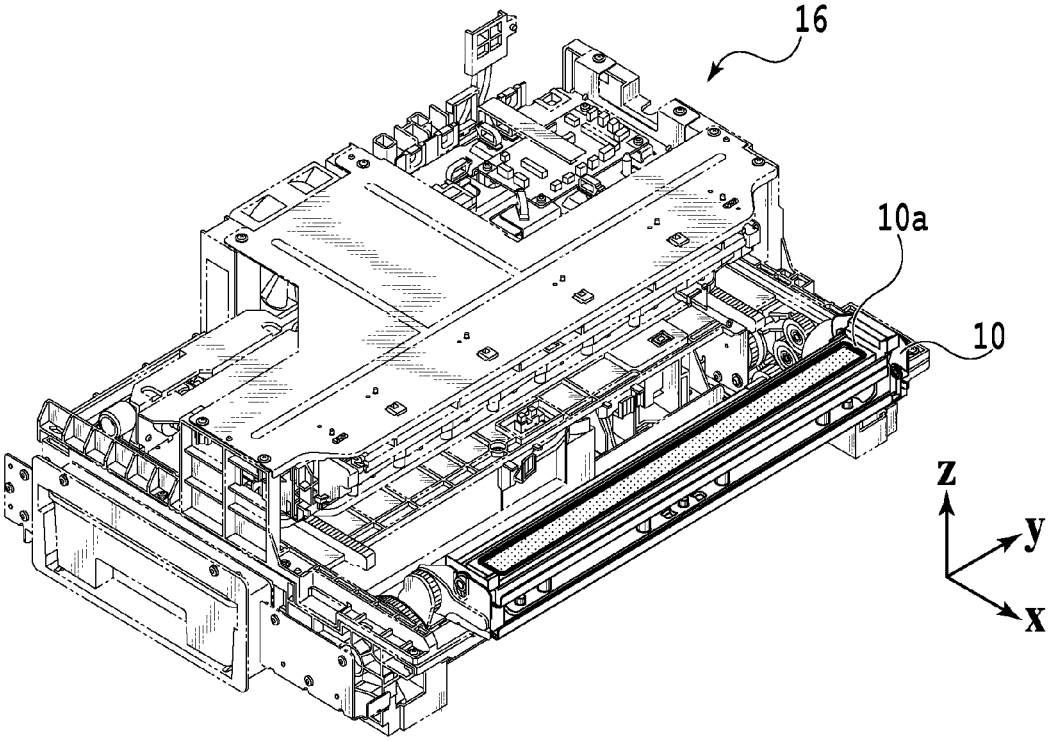
FIG. 5A and FIG. 5B are perspective views illustrating the configuration of a maintenance unit.
Figure 5B:
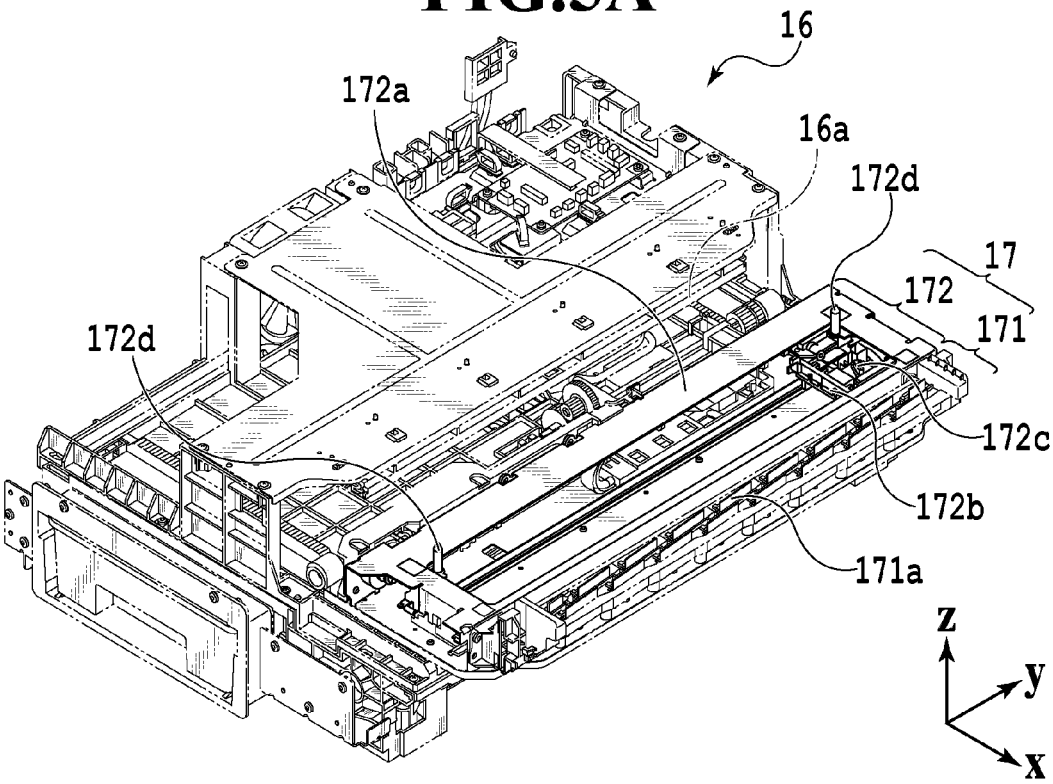

FIG. 5A is a perspective view illustrating the maintenance unit 16 at its standby position. FIG. 5B is a perspective view illustrating the maintenance unit 16 at its maintenance position. FIG. 5A corresponds to FIG. 1, and FIG. 5B corresponds to FIG. 4. When the print head 8 is at its standby position, the maintenance unit 16 is at its standby position illustrated in FIG. 5A and therefore the cap unit 10 is moved upward in the vertical direction and the wiping unit 17 is housed in the maintenance unit 16. The cap unit 10 has a cap member 10*a* in a box shape extending in the y-direction, which is brought into close contact with the ejection opening surface 8*a* of the print head 8 to prevent the evaporation of liquid in ink through the ejection openings. The cap unit 10 also has a function of collecting the inks ejected onto the cap member 10*a* for preliminary ejection or the like and sucking the collected inks with a suction pump not illustrated.

On the other hand, at the maintenance position illustrated in FIG. 5B, the cap unit 10 is moved downward in the vertical direction and the wiping unit 17 is pulled out of the maintenance unit 16. The wiping unit 17 includes two wiper units, namely a blade wiper unit 171 and a vacuum wiper unit 172.

In the blade wiper unit 171, blade wipers 171*a* that wipe the ejection opening surface 8*a* in the x direction are disposed along they direction over a length corresponding to the region along which the ejection ports are aligned. To perform a wiping operation using the blade wiper unit 171, the wiping unit 17 moves the blade wiper unit 171 in the x direction with the print head 8 positioned at such a height level that the print head 8 can contact the blade wipers 171*a*. With this movement, the blade wipers 171*a* wipe the inks and the like attached to the ejection opening surface 8*a*.

At the inlet of the maintenance unit 16 through which the blade wipers 171*a* are housed, a wet wiper cleaner 16*a* is disposed which removes the inks attached to the blade wipers 171*a* and applies a wetting liquid to the blade wipers 171*a*. Each time the blade wipers 171*a* are housed into the maintenance unit 16, the matters attached to the blade wipers 171*a* are removed and the wetting liquid is applied thereto by the wet wiper cleaner 16*a*. Then, the next time the blade wipers 171*a* wipe the ejection opening surface 8*a*, the wetting liquid is transferred onto the ejection opening surface 8*a*, thereby improving the lubricity between the ejection opening surface 8*a* and the blade wipers 171*a*.

On the other hand, the vacuum wiper unit 172 includes a flat plate 172*a* with an opening portion extending in the y direction, a carriage 172*b* capable of moving in the y direction within the opening portion, and a vacuum wiper 172*c* mounted on the carriage 172*b*. The vacuum wiper 172*c* is disposed so as to be capable of wiping the ejection opening surface 8*a* in the y direction with movement of the carriage 172*b*. At the tip of the vacuum wiper 172*c*, a suction port is formed which is connected to a suction pump not illustrated. Thus, by moving the carriage 172*b* in they direction with the suction pump actuated, the inks and the like attached to the ejection opening surface 8*a* of the print head 8 are wiped by the vacuum wiper 172*c* and sucked into the suction port. In this operation, the flat plate 172*a* and positioning pins 172*d* provided at opposite ends of its opening portion are used to position the ejection opening surface 8*a* relative to the vacuum wiper 172*c*.

In this embodiment, it is possible to perform a first wiping process in which the wiping operation by the blade wiper unit 171 is performed but the wiping operation by the vacuum wiper unit 172 is not performed and a second wiping process in which both wiping processes are sequentially performed. To perform the first wiping process, the print controller 202 first pulls the wiping unit 17 out of the maintenance unit 16 with the print head 8 retreated to above the maintenance position in FIG. 4 in the vertical direction. The print controller 202 then moves the print head 8 downward in the vertical direction to such a position that the print head 8 can contact the blade wipers 171*a*, and thereafter moves the wiping unit 17 to the inside of the maintenance unit 16. With this movement, the blade wipers 171*a* wipe the inks and the like attached to the ejection opening surface 8*a*. Specifically, the blade wipers 171*a* wipe the ejection opening surface 8*a* as they are moved from the position to which the wiping unit 17 has been pulled out of the maintenance unit 16 to the inside of the maintenance unit 16.

After housing the blade wiper unit 171, the print controller 202 moves the cap unit 10 upward in the vertical direction to thereby bring the cap member 10*a* into tight contact with the ejection opening surface 8*a* of the print head 8. The print controller 202 then drives the print head 8 in this state to cause it to perform preliminary ejection, and sucks the inks collected in the cap member 10*a* with the suction pump.

On the other hand, to perform the second wiping process, the print controller 202 first slides the wiping unit 17 to pull it out of the maintenance unit 16 with the print head 8 retreated to above the maintenance position in FIG. 4 in the vertical direction. The print controller 202 then moves the print head 8 downward in the vertical direction to such a position that the print head 8 can contact the blade wipers 171*a*, and thereafter moves the wiping unit 17 to the inside of the maintenance unit 16. As a result, the wiping operation by the blade wipers 171*a* is performed on the ejection opening surface 8*a*. Subsequently, the print controller 202 slides the wiping unit 17 to pull it out of the maintenance unit 16 to a predetermined position with the print head 8 retreated to above the maintenance position in FIG. 4 in the vertical direction again. The print controller 202 then positions the ejection opening surface 8*a* and the vacuum wiper unit 172 relative to each other by using the flat plate 172*a* and the positioning pins 172*d* while lowering the print head 8 to the maintenance position illustrated in FIG. 4. The print controller 202 thereafter performs the above-described wiping operation by the vacuum wiper unit 172. The print controller 202 retreats the print head 8 upward in the vertical direction and houses the wiping unit 17, and then performs preliminary ejection into the cap member and the operation of sucking the collected inks with the cap unit 10, as in the first wiping process.

As described above, the print controller 202 functions as a control unit that controls the wiping operation performed by the blade wiper unit 171 and the vacuum wiper unit 172. This control unit may include the head carriage control unit 208 and the maintenance control unit 210.

Figure 6:
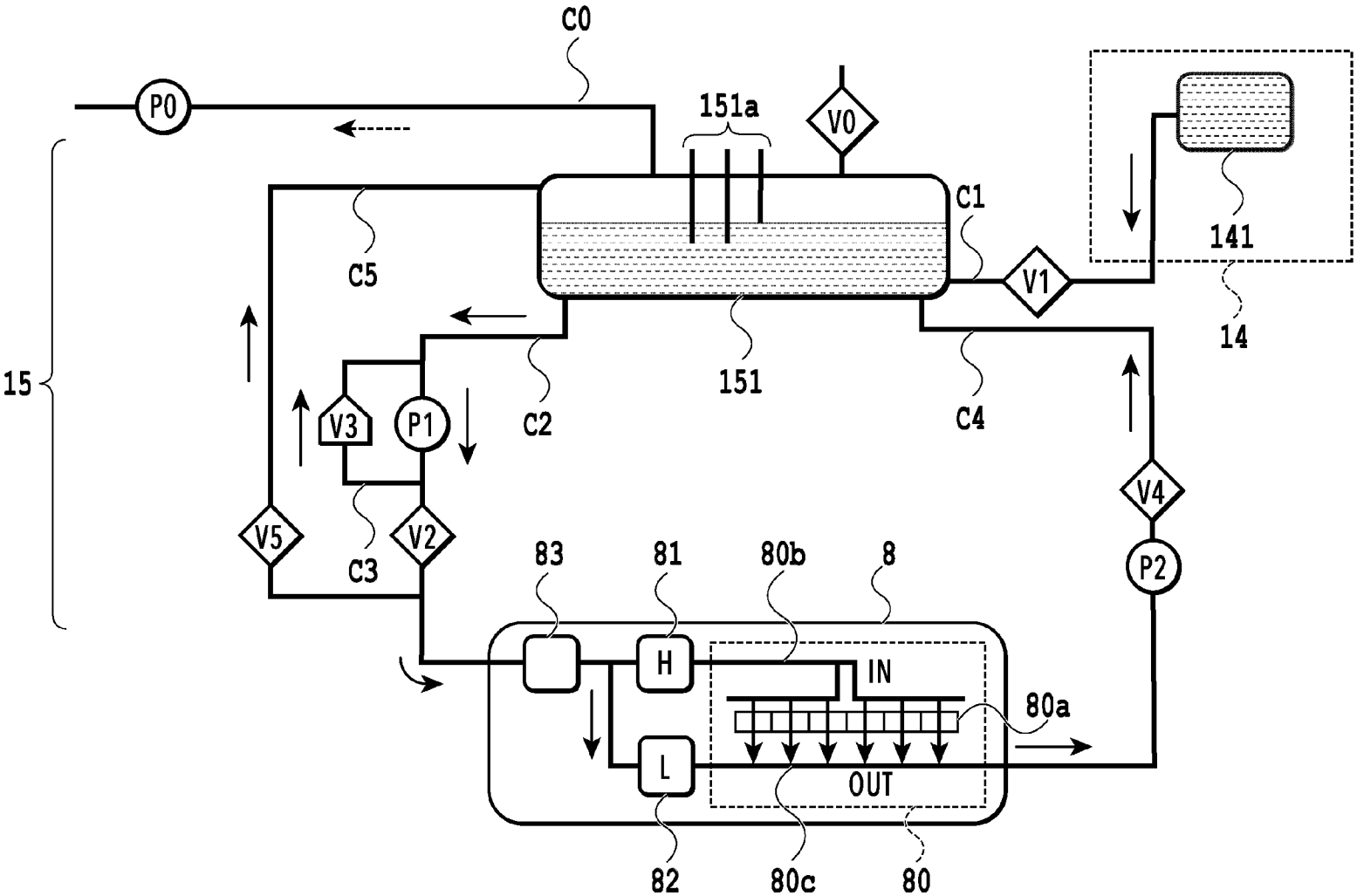
FIG. 6 is a schematic configuration diagram of an ink supply system.

Next, the ink supply system of the print head 8 will be described. The present embodiment employs a circulation type ink supply system as described above. FIG. 6 is a diagram illustrating the flow path configuration of the circulation type ink supply system including the ink supply unit 15, employed in the inkjet printing apparatus 1 of the present embodiment. The ink supply unit 15 supplies ink supplied from the ink tank unit 14 to the print head 8 (head unit). Although FIG. 6 shows a configuration for one color ink, such a configuration is actually prepared for each ink color. The ink supply unit 15 is basically controlled by the ink supply control unit 209 via the print controller 202. Constituents of the ink supply unit 15 will be described below.

Ink circulates mainly between a sub-tank 151 and the print head 8. In the print head 8, ink ejection operation is performed based on image data and ink that was not ejected is collected back into the sub-tank 151.

The sub-tank 151 that contains a certain amount of ink is connected to a supply flow path C2 for supplying ink to the print head 8 and a collection flow path C4 for collecting ink from the print head 8. In other words, the sub-tank 151, the supply flow path C2, the print head 8, and the collection flow path C4 compose a circulation flow path (circulation path) in which ink circulates. The sub-tank 151 is also connected to an air flow path C0 in which air flows.

In the sub-tank 151 is provided a liquid level detection unit 151*a* including a plurality of electrode pins. The ink supply control unit 209 detects the presence/absence of a conducting current between those pins so as to grasp the height of the ink liquid level, that is, the amount of remaining ink inside the sub-tank 151. A vacuum pump P0 (in-tank vacuum pump) is a negative pressure generating source for reducing the pressure inside the sub-tank 151. An atmosphere release valve V0 is a valve for switching whether or not to cause the inside of the sub-tank 151 to communicate with atmosphere.

A main tank 141 is a tank that contains ink to be supplied to the sub-tank 151. The main tank 141 is configured to be detachable from the printing apparatus body. The sub-tank 151 and the main tank 141 are connected with a tank connection flow path C1, on which is provided a tank supply valve V1 for switching the connection between the sub-tank 151 and the main tank 141.

In the case where the liquid level detection unit 151*a* detects that the amount of ink inside the sub-tank 151 is less than a certain amount, the ink supply control unit 209 closes the atmosphere release valve V0, a supply valve V2, a collection valve V4, and a head replacement valve V5. In addition, the ink supply control unit 209 opens the tank supply valve V1. In this state, the ink supply control unit 209 activates the vacuum pump P0. This makes the pressure inside the sub-tank 151 negative, so that ink is supplied from the main tank 141 to the sub-tank 151. In the case where the liquid level detection unit 151*a* detects that the amount of ink inside the sub-tank 151 exceeds a certain amount, the ink supply control unit 209 closes the tank supply valve V1 and stops the vacuum pump P0.

The supply flow path C2 is a flow path for supplying ink from the sub-tank 151 to the print head 8, and on the supply flow path C2 are provided a supply pump P1 and the supply valve V2. During print operation, the supply pump P1 is driven with the supply valve V2 open, supplying ink to the print head 8 while circulating ink in the circulation path. The amount of ink ejected per unit time by the print head 8 varies according to image data. The flow rate of the supply pump P1 is determined such that the flow rate can support the print head 8 performing ejection operation that requires maximum ink consumption per unit time.

A relief flow path C3 is a flow path which is located upstream of the supply valve V2 and which connects the upstream side and the downstream side of the supply pump P1. On the relief flow path C3 is provided a relief valve V3 which is a differential pressure valve. The relief valve V3 is not opened or closed by a drive mechanism. The relief valve V3 is urged by a spring and configured to open in the case where the pressure reaches a specified pressure. For example, in the case where the amount of ink supply from the supply pump P1 per unit time is larger than the sum value of the amount of ejection of the print head 8 per unit time and the amount of flow (the amount of pulled-back ink) through a collection pump P2 per unit time, the relief valve V3 opens according to the pressure applied to the relief valve V3. As a result, a cyclic flow path is formed which is composed of part of the supply flow path C2 and the relief flow path C3. Providing the relief flow path C3 allows the amount of ink supply to the print head 8 to be adjusted according to the amount of ink consumed by the print head 8, thus stabilizing the pressure inside the circulation path irrespective of image data.

The collection flow path C4 is a flow path for collecting ink from the print head 8 back to the sub-tank 151, and the collection pump P2 and the collection valve V4 are provided on the collection flow path C4. The collection pump P2 serves as a negative pressure generating source to suck ink from the print head 8 at the time of circulating ink within the circulation path. Driving the collection pump P2 generates an appropriate differential pressure between an IN flow path 80*b* and an OUT flow path 80*c* inside the print head 8, so that ink can be circulated between the IN flow path 80*b* and the OUT flow path 80*c*.

The collection valve V4 is a valve for preventing backflow at the time of not performing print operation, that is, at the time of not circulating ink within the circulation path. In the circulation path of the present embodiment, the sub-tank 151 is located higher than the print head 8 in the vertical direction (see FIG. 1). For this reason, in the case where the supply pump P1 or the collection pump P2 is not driven, there is a possibility that ink flows back in the collection flow path C4 from the sub-tank 151 to the print head 8 due to a water head difference between the sub-tank 151 and the print head 8. In order to prevent such backflow, the collection valve V4 is provided on the collection flow path C4 in the present embodiment.

Note that the supply valve V2 also serves as a valve for preventing ink supply from the sub-tank 151 to the print head 8 while print operation is not performed, that is, while ink is not circulated within the circulation path.

A head replacement flow path C5 is a flow path connecting the supply flow path C2 and an air chamber (space in which ink is not contained) of the sub-tank 151, and the head replacement valve V5 is located on the head replacement flow path C5. One end of the head replacement flow path C5 is connected to a point upstream of the print head 8 and downstream of the supply valve V2 on the supply flow path C2. The other end of the head replacement flow path C5 is connected to an upper part of the sub-tank 151 to communicate with the air chamber inside the sub-tank 151. The head replacement flow path C5 is used in the case of pulling out ink from the print head 8 in use such as at the time of replacement of the print head 8 or at the time of transportation of the printing apparatus 1. The head replacement valve V5 is controlled by the ink supply control unit 209 so as to be closed except for a case of putting ink into the print head 8 and a case of collecting ink from the print head 8 via the head replacement valve V5.

Next, the flow path configuration inside the print head 8 will be described. Ink supplied through the supply flow path C2 to the print head 8 passes through a filter 83 and is then supplied to a first negative pressure control unit 81 and a second negative pressure control unit 82. The first negative pressure control unit 81 has a control pressure set to a low negative pressure (negative pressure having a small pressure difference from atmospheric pressure). The second negative pressure control unit 82 has a control pressure set to a high negative pressure (negative pressure having a large pressure difference from atmospheric pressure). The pressures of those first negative pressure control unit 81 and second negative pressure control unit 82 are generated within adequate ranges by driving the collection pump P2.

The print head 8 includes an ink ejection part 80 for ejecting ink. In this ink ejection part 80, a plurality of printing element substrates 80*a*, each having multiple, arrayed ejection openings, are arranged to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in the direction in which the printing element substrates 80*a* are arrayed. Each printing element substrate 80*a* has individual supply flow paths connected to the common supply flow path 80*b* and individual collection flow paths connected to the common collection flow path 80*c*. Thus, an ink flow is generated in each printing element substrate 80*a* such that ink flows in from the common supply flow path 80*b* having relatively lower negative pressure and flows out to the common collection flow path 80*c* having relatively higher negative pressure. A pressure chamber which communicates with each ejection opening and is charged with ink is provided on a path between the individual supply flow path and the individual collection flow path, so that an ink flow is also generated even in the ejection openings and pressure chambers where printing is not performed. In the case where ejection operation is performed in the printing element substrate 80*a*, part of the ink moving from the common supply flow path 80*b* to the common collection flow path 80*c* is ejected from the ejection opening and thus is consumed, and the ink that was not ejected moves into the collection flow path C4 through the common collection flow path 80*c*.

Figure 7A:
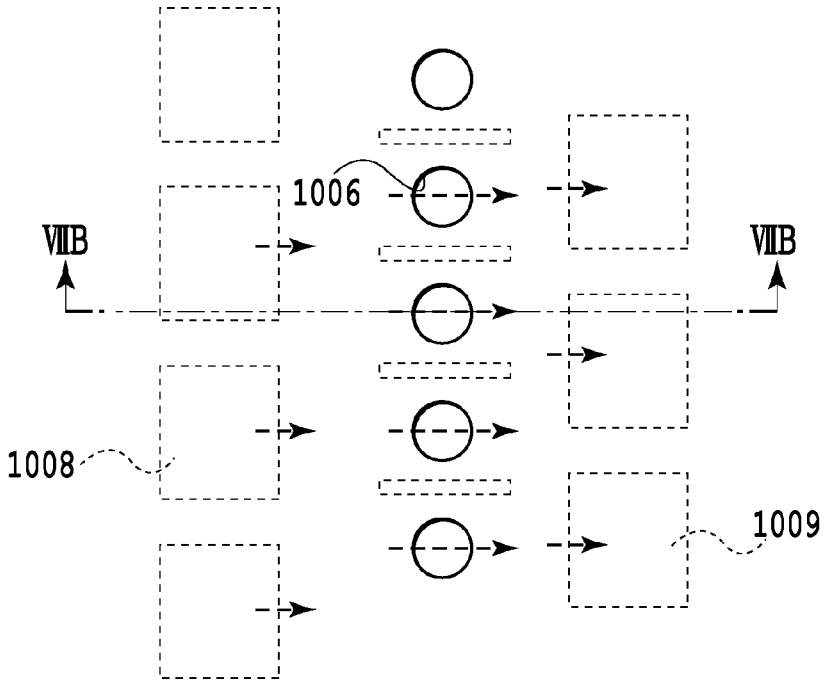
FIGS. 7A and 7B are diagrams for explaining the flow of ink in flow paths including ejection openings.
Figure 7B:
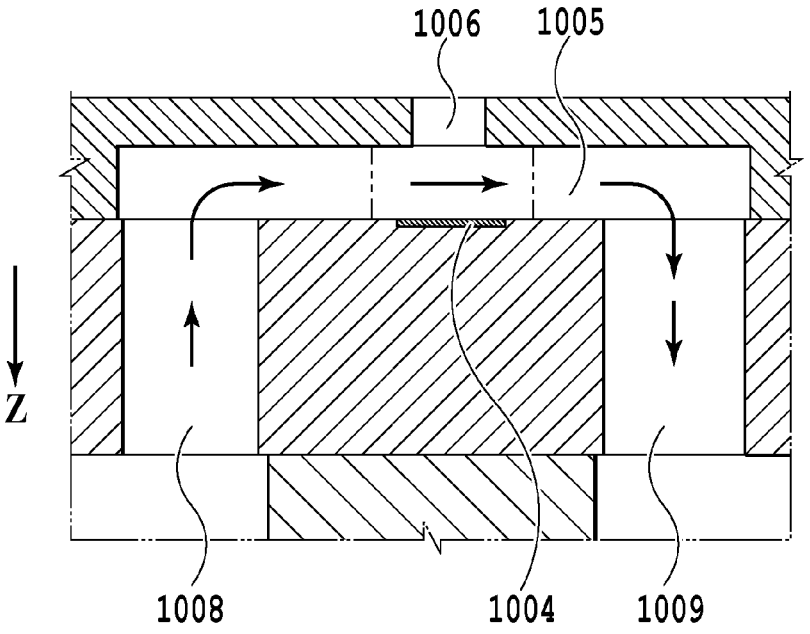

FIG. 7A is an enlarged schematic plan view of part of the printing element substrate 80*a*, and FIG. 7B is a schematic cross-sectional view taken along line VIIB-VIIB in FIG. 7A. The printing element substrate 80*a* has a pressure chamber 1005 which is filled with ink and an ejection opening 1006 for ejecting ink. In the pressure chamber 1005, a printing element 1004 is provided at a position facing the ejection opening 1006. The printing element substrate 80*a* has an individual supply flow path 1008 connected to the common supply flow path 80*b* and an individual collection flow path 1009 connected to the common collection flow path 80*c* for each ejection opening 1006.

The foregoing configuration generates, in the printing element substrate 80*a*, an ink flow in which ink flows in from the common supply flow path 80*b* having relatively low negative pressure (whose absolute value is high) and flows out to the common collection flow path 80*c* having relatively high negative pressure (whose absolute value is low). To be more specific, ink flows in the order of the common supply flow path 80*b*, the individual supply flow path 1008, the pressure chamber 1005, the individual collection flow path 1009, and the common collection flow path 80*c*. When ink is ejected by the printing element 1004, part of the ink moving from the common supply flow path 80*b* to the common collection flow path 80*c* is ejected through the ejection opening 1006 and discharged to the outside of the print head 8. The ink that was not ejected from the ejection opening 1006 is collected into the collection flow path C4 through the common collection flow path 80*c*.

With the configuration above, at the time of performing print operation, the ink supply control unit 209 closes the tank supply valve V1 and the head replacement valve V5, opens the atmosphere release valve V0, the supply valve V2, and the collection valve V4, and drives the supply pump P1 and the collection pump P2. As a result, a circulation path composed of the sub-tank 151, the supply flow path C2, the print head 8, the collection flow path C4, and the sub-tank 151 is established. In the case where the amount of ink supply per unit time from the supply pump P1 is larger than the sum value of the ejection amount per unit time of the print head 8 and the amount of flow per unit time through the collection pump P2, ink flows into the relief flow path C3 from the supply flow path C2. Thus, the flow rate of the ink flowing into the print head 8 from the supply flow path C2 is adjusted.

While print operation is not performed, the ink supply control unit 209 does not operate the supply pump P1 and the collection pump P2 and keeps closed the atmosphere release valve V0, the supply valve V2, and the collection valve V4. Thereby the flow of ink inside the print head 8 is stopped, and the backflow due to the water head difference between the sub-tank 151 and the print head 8 is also prevented. In addition, closing the atmosphere release valve V0 prevents ink leakage and the evaporation of liquid in ink from the sub-tank 151.

In the case of collecting ink from the print head 8, the ink supply control unit 209 closes the atmosphere release valve V0, the tank supply valve V1, the supply valve V2, and the collection valve V4, opens the head replacement valve V5, and drives the vacuum pump P0. As a result, the pressure inside sub-tank 151 becomes negative, and the ink inside the print head 8 is collected into the sub-tank 151 through the head replacement flow path C5. Hence, the head replacement valve V5 is a valve which is closed during the ordinary print operation and in the standby state and is opened at the time of collecting ink from the print head 8. Note that the head replacement valve V5 is also opened at the time of filling the head replacement flow path C5 with ink in the case of filling the print head 8 with ink.

Figure 8A:
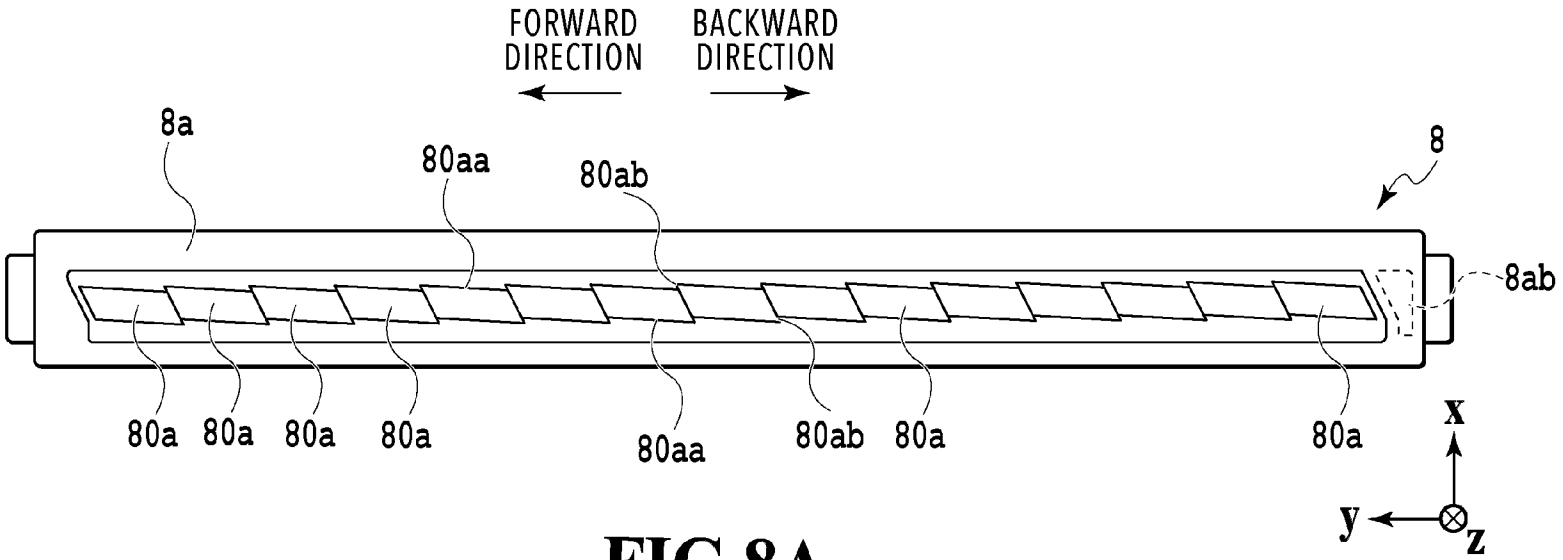
FIGS. 8A and 8B are diagrams for explaining printing element substrates arrayed on the ejection opening surface.
Figure 8B:
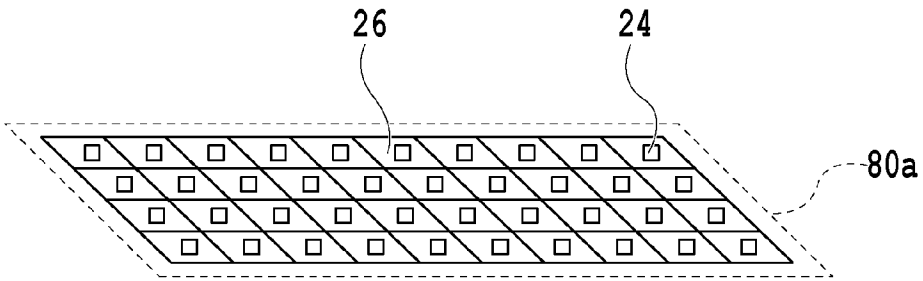

Next, a configuration for controlling the temperature of the print element substrate 80*a* within a specified range will be described. FIG. 8A is a schematic configuration diagram of the ejection opening surface 8*a* of the print head 8. FIG. 8B is a schematic configuration diagram of sub heaters 26 provided to the print head 8. Note that FIG. 8A is a view of the ejection opening surface 8*a* from the bottom surface, which is simplified to make it easy to understand by omitting some constituents such as a wiring sealing portion.

On the ejection opening surface 8*a* are arranged multiple printing element substrates 80*a* along the y-direction, each having the same dimensions and the same configuration. In the wiping operation using the vacuum wiper unit 172, the recovery process is performed for the ejection openings 1006 of the printing element substrate 80*a* while the print controller 202 is moving the vacuum wiper 172*c* in the y-direction via the carriage 172*b*. Note that in the following description, the wiping operation using the vacuum wiper unit 172, which is a recovery process, is referred to as "suction wiping".

On the printing element substrate 80*a* (substrate), the ejection openings 1006 arrayed in parallel with the long sides 80*aa* form the ejection opening array (not illustrated). The ejection opening array is parallelly arranged for each kind of ink along the short sides 80*ab*. When the vacuum wiper 172*c* moves in the y-direction kept in contact with the ejection opening surface 8*a*, the vacuum wiper 172*c* performs sucking operation for the area including part of the ejection opening array in the x-direction. The area where the vacuum wiper 172*c* moves in the suction wiping includes all the printing element substrates 80*a*. Note that in the present embodiment, the vacuum wiper 172*c* performs suction wiping while the vacuum wiper 172*c* is moving in the forward direction, which is movement from one end to the other end in the y-direction, and the vacuum wiper 172*c* does not perform suction wiping while the vacuum wiper 172*c* is moving in the backward direction, which is movement from the other end to the one end.

In addition, the printing element substrate 80*a* has the sub heaters 26 for controlling the temperatures of the printing element substrates 80*a* within a specified range as illustrated in FIG. 8B to achieve stable ink ejection from each ejection opening 1006. The sub heaters 26 are heaters different from the print elements 1004 (heaters) which are the ejection-energy generating elements provided being associated with the respective ejection openings 1006. Note that although in FIG. 8B, the printing element substrate 80*a* is divided into 40 areas in a lattice shape, and a sub heater 26 is provided in each divided area, the number and arrangement of sub heaters 26 are not limited to the configuration illustrated in FIG. 8B. Specifically, the number and the arrangement positions may be modified as appropriate as long as the configuration allows the sub heaters 26 to adjust the temperature of the entire printing element substrate 80*a*.

Each sub heater 26 has a temperature sensor 24 capable of obtaining information on temperature (hereinafter, referred to as "temperature information" as appropriate). In other words, in the present embodiment, temperature information on the printing element substrates 80*a*, in other words, the ejection opening surface 8*a*, is obtained using the temperature sensors 24. Note that the number and arrangement of temperature sensors 24 are also not limited to the configuration illustrated in FIG. 8B. In other words, the number and the arrangement positions may be modified as appropriate as long as the configuration allows the temperature information on the sub heaters 26 to be obtained appropriately. The array arrangement and shape of the printing element substrates 80*a* are not limited to the configuration illustrated in FIG. 8A. For example, the shape of the printing element substrate may be a quadrangle such as a rectangle or a trapezoid. In this case, the printing element substrates may be arranged in multiple rows or may be arrayed in a staggered manner.

The temperature information obtained by the temperature sensors 24 (obtaining unit) is outputted sequentially to the print controller 202 via the head I/F 206. The print controller 202 stores the outputted temperature information and creates a temperature history. Note that this temperature history includes a temperature history recorded after the last (the latest) wiping process finishes. In addition, the highest value within outputted temperature information is stored as the highest reached temperature Tmax of a printing element substrate 80*a*, and the highest reached temperature Tmax is updated based on the temperature information sequentially outputted. Such update of the highest reached temperature Tmax (the highest temperature) described above is performed for each printing element substrate 80*a*.

With the configuration above, the wiping process by the wiping unit 17 for the print head 8 (printing unit) will be described. In the printing apparatus 1, in parallel with printing process, a determining process is performed for determining a wiping process suitable for the state of ink attached to the ejection opening surface 8*a* and executing it. Specifically, in the present embodiment, a first wiping process or a second wiping process is selected to be executed in the determining process based on the state of ink attached to the ejection opening surface 8*a*.

In the printing apparatus 1, after a printing process for performing printing on a print medium being conveyed starts, the print controller 202 starts counting, based on print data, the number of ink ejections from the ejection openings 1006 of each printing element substrate 80*a* in printing (the number of ink ejections). The print controller 202 also updates sequentially the highest reached temperature Tmax at each printing element substrate 80*a* based on the temperature information outputted from the temperature sensor 24. Note that the number of ink ejections at each printing element substrate 80*a* is counted based on print data generated by the image processing controller 205. Note that the number of ink ejections is counted from the time when the latest (last) wiping process finishes.

First Embodiment

Figure 9:
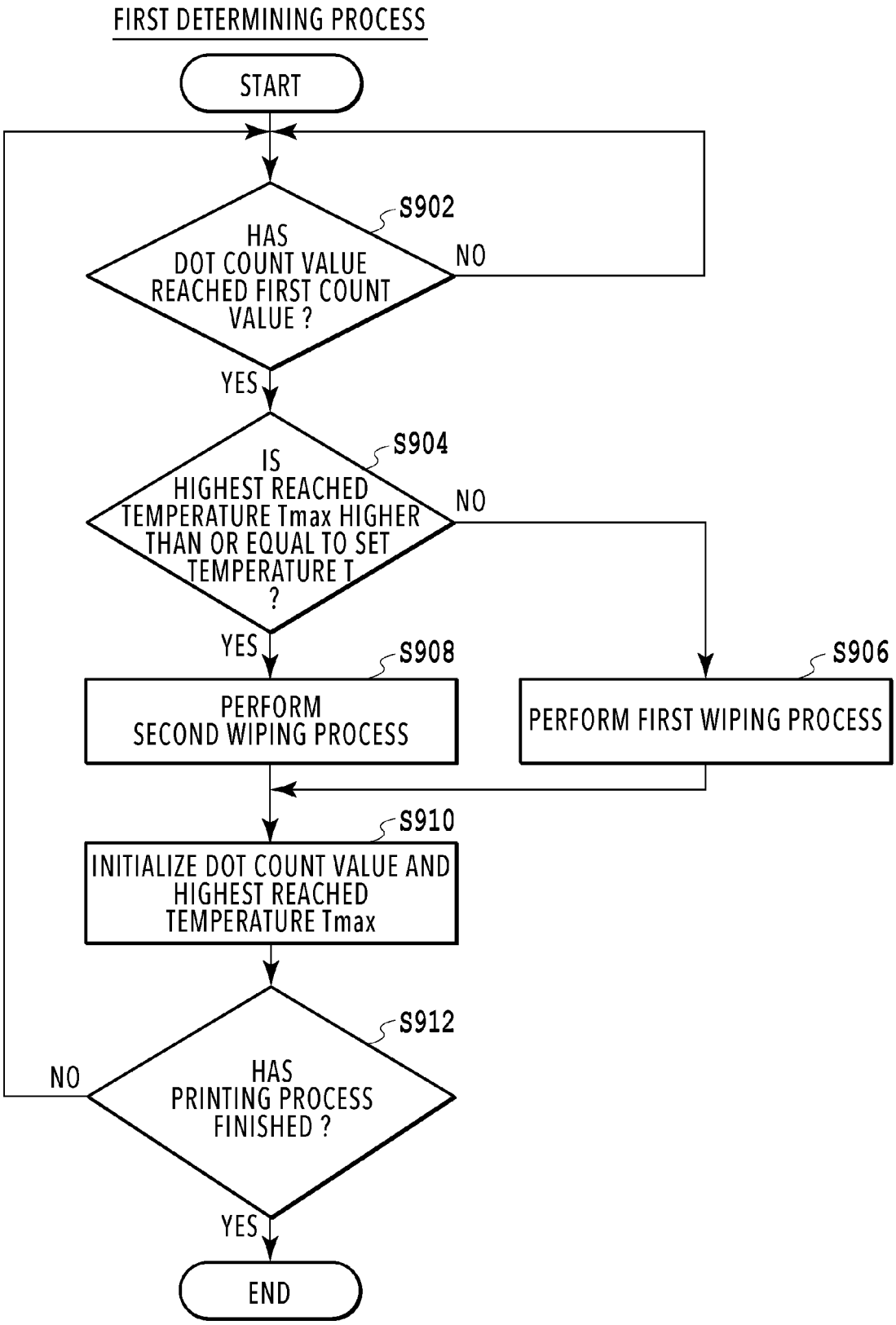
FIG. 9 is a flowchart illustrating detailed process procedure of a first determining process.

The following is a description of a determining process according to a first embodiment, executed in the printing apparatus 1. Note that in the following description, the determining process according to the first embodiment is referred to as a first determining process. FIG. 9 is a flowchart illustrating detailed process procedure of the first determining process.

When the first determining process starts, first the print controller 202 determines whether the number of ink ejections (hereinafter, also referred to as the "dot count value" as appropriate) has reached a first count value (S902). At this S902, it is determined whether there is a printing element substrate 80*a* the dot count value of which has reached the first count value, which is a set value. The first count value is a value indicating the number of ink ejections that makes it likely to cause the degradation of the ink ejection performance of the ejection opening 1006 because of ink attached to the ejection opening surface 8*a* due to rebounding from print media S or other reasons. Since such a first count value varies depending on the kind of ink, the kind of print media, and other factors, the first count value is, for example, determined experimentally and set appropriately.

At S902, if it is determined that the dot count value has not reached the first count value, in other words, it is determined that there is no printing element substrate 80*a* the dot count value of which has reached the first count value, the process at S902 is performed again. In other words, in the first determining process, the process in S902 is executed repeatedly until it is determined that the dot count value has reached the first count value, or specifically, until it is determined that there is a printing element substrate 80*a* the dot count value of which has reached the first count value.

If it is determined at S902 that the dot count value has reached the first count value, it is determined whether the highest reached temperature Tmax of the printing element substrate 80*a* the dot count value of which is determined to have reached the first count value is higher than or equal to a set temperature T (S904). Note that the determination described above is executed by the print controller 202. The set temperature T (specified value) is set to a temperature at which the ink attached to the ejection opening surface 8*a* is likely to solidify. Since this set temperature T varies depending on the kind of ink and other factors, it is set appropriately.

If it is determined at S904 that the highest reached temperature Tmax is lower than the set temperature T, the first wiping process is executed in which only wiping operation using the blade wiper unit 171 (hereinafter referred to as blade wiping) is performed (S906). If it is determined at S904 that the highest reached temperature Tmax is higher than or equal to the set temperature T, the second wiping process is executed in which suction wiping is performed after the blade wiping (S908). Note that a determined wiping process may be executed, for example, when a print operation for one line has finished, or it may be executed when a print operation for a print medium in printing has finished.

The determination process at S904 is a process to determine whether the ink attached to the ejection opening surface 8*a* (the surface of the printing element substrate 80*a* that faces print media S) has solidified. Specifically, if it is determined that the highest reached temperature Tmax is lower than the set temperature T (lower than the specified value), it is determined that the ink attached to the ejection opening surface 8*a* is not solidified and hence the ink can be removed by blade wiping. If it is determined that the highest reached temperature Tmax is higher than or equal to the set temperature T (higher than or equal to the specified value), it is determined that the ink attached to the ejection opening surface 8*a* may be solidified and hence the ink can be removed by blade wiping and suction wiping.

Here, the suction wiping is a process in which wiping is performed while a negative pressure is being applied to the ejection opening surface 8*a*. In the suction wiping, the magnitude of the negative pressure applied to the ejection opening surface 8*a* and the time during which the negative pressure is applied can be adjusted. For this reason, the suction wiping is superior to the blade wiping in the performance of removing ink from the ejection opening surface 8*a* and hence provides a larger cleaning effect than the blade wiping. Accordingly the suction wiping can remove the ink attached and solidified on the ejection opening surface 8*a* more reliably than blade wiping. Hence, with the second wiping process including suction wiping in addition to blade wiping, the ink attached and solidified on the ejection opening surface 8*a* can be removed more reliably.

When the wiping process is executed, the dot count value and the highest reached temperature Tmax are initialized (S910), and it is determined whether the printing process has finished (S912). At S912, if it is determined that the printing process has not finished, the process returns to S902, or If it is determined that the printing process has finished, this first determining process ends.

Figure 10:
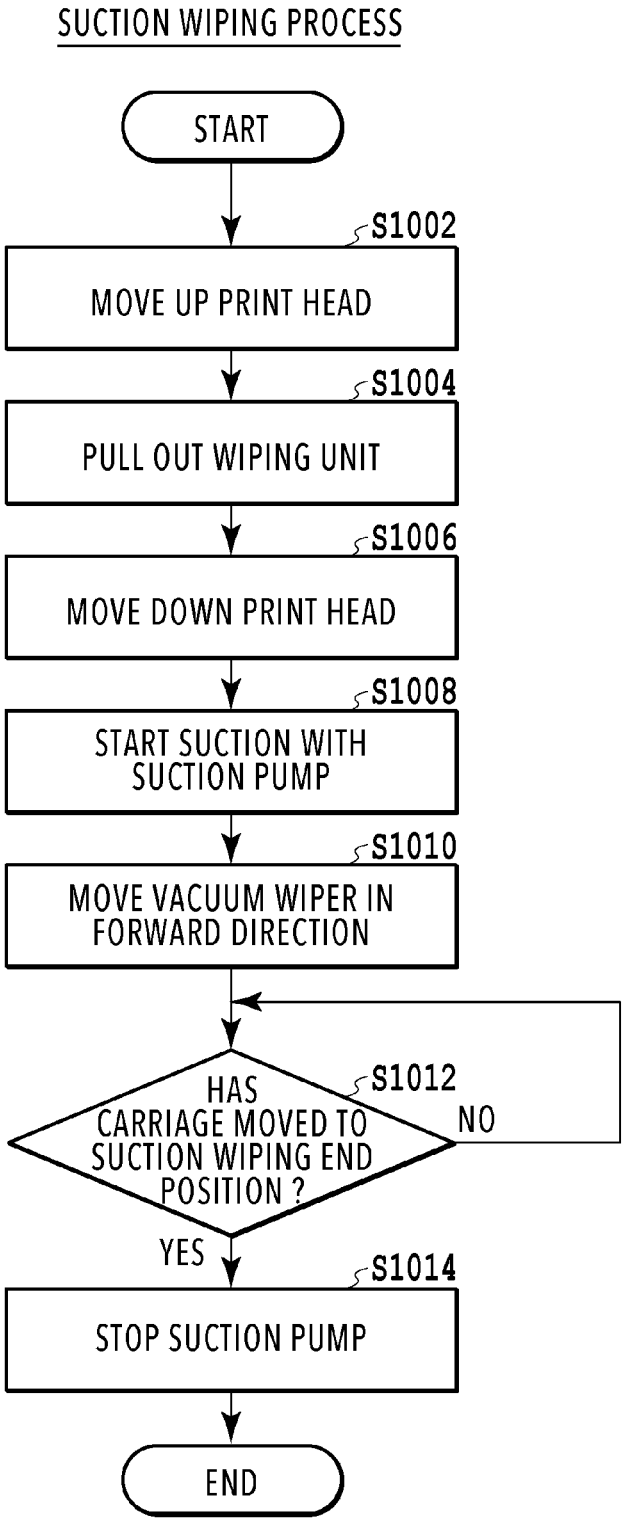
FIG. 10 is a flowchart illustrating detailed process procedure of a suction wiping process.

As described above, in the second wiping process, suction wiping is executed after blade wiping. Here, the suction wiping process for executing suction wiping will be described with reference to FIG. 10. FIG. 10 is a flowchart illustrating detailed process procedure of the suction wiping process.

When blade wiping finishes, the carriage 172*b* is moved from the wiping start position in FIG. 8B in the forward direction until it reaches the end of the movement range to find the home position, and then the carriage 172*b* is moved to the wiping start position in the backward direction. After that, the suction wiping process starts. When the suction wiping process starts, first the print controller 202 retreats the print head 8, which is at the position where the print head 8 can come into contact with the blade wipers 171*a*, to a position higher in the vertical direction than the wiping position illustrated in FIG. 4 (S1002). Next, the print controller 202 slides and pulls out the wiping unit 17 housed in the maintenance unit 16 to a specified position (S1004).

After that, the print controller 202 moves down the print head 8 to the wiping position illustrated in FIG. 4 (S1006). At this time, the carriage 172*b* is at the suction-wiping start position which is at one end in the y-direction of the wiping unit 17 (see FIG. 5B). Then, the vacuum wiper 172*c* mounted on the carriage 172*b* comes into contact with a suction preparation surface 8*ab* on the ejection opening surface 8*a* (see FIG. 8A).

Next, the print controller 202 drives the suction pump to apply negative pressure to the ejection opening surface 8*a* which is now in contact with the vacuum wiper 172*c* (S1008). The suction pump is kept being driven such that the negative pressure applied to the ejection opening surface 8*a* can be within a specified range during the suction wiping. After that, the vacuum wiper 172*c* is moved in the forward direction, kept in contact with the ejection opening surface 8*a* to perform suction wiping on each ejection opening 1006 located on the ejection opening surface 8*a* of the printing element substrate 80*a* (S1010). In other words, at S1010, the movement of the carriage 172*b* in the forward direction by the print controller 202 moves the vacuum wiper 172*c*, performing sucking on the ejection opening surface 8*a*, in the forward direction.

Then, it is determined whether the carriage 172*b* has moved to the suction wiping end position set in advance (S1012). Meanwhile, an encoder (not illustrated) is provided for the vacuum wiper unit 172 for detecting the moving direction and moving distance of the carriage 172*b*. Thus, at S1012, this encoder is used to determine whether the carriage 172*b* has moved to the suction wiping end position.

If it is determined at S1012 that the carriage 172*b* has moved to the suction wiping end position, it is determined that the suction wiping has finished, driving the suction pump is stopped (S1014), and the suction wiping process ends.

As has been described above, the printing apparatus 1 obtains, based on print data, the dot count value which is the number of ink ejections of each printing element substrate 80*a*. In addition, the printing apparatus 1 obtains the highest reached temperature Tmax at each printing element substrate 80*a* based on the temperature information outputted from the temperature sensor 24. Then, in the determining process according to the first embodiment, in the case where the highest reached temperature Tmax of the printing element substrate 80*a* the dot count value of which has reached the first count value is lower than the set temperature T, the first wiping process is executed. In the case where the highest reached temperature Tmax is higher than or equal to the set temperature T, the second wiping process is executed. With this process, in the printing apparatus 1, in the case where it is unlikely that the ink that is attached to the ejection opening surface 8*a* and degrades the ejection performance of the ejection openings 1006 has solidified, only blade wiping is executed. In the case where it is likely that the attached ink has solidified, suction wiping suitable for removing solidified ink is executed along with blade wiping.

Second Embodiment

Figure 11:
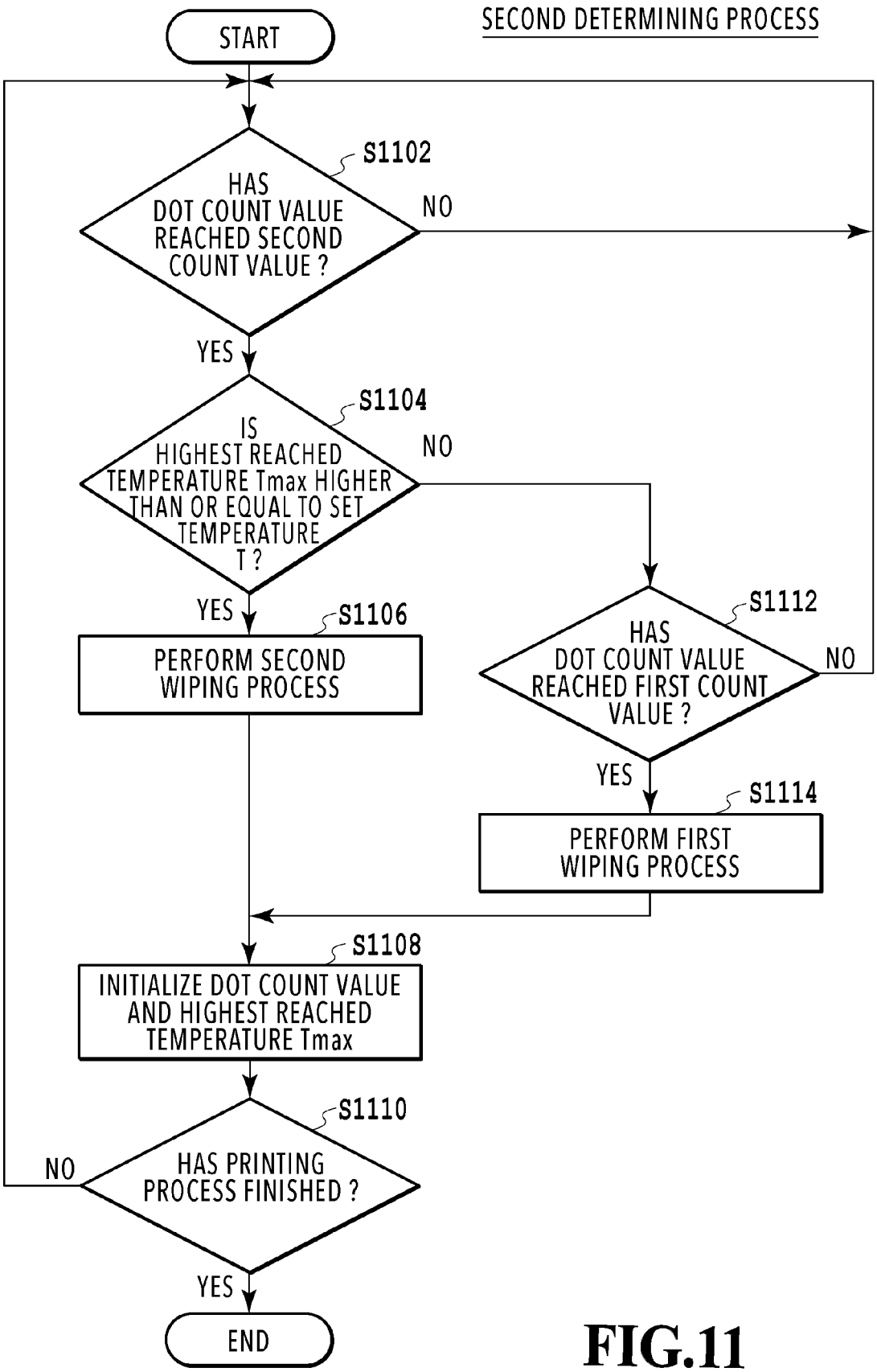
FIG. 11 is a flowchart illustrating detailed process procedure of a second determining process.

Next, a determining process according to a second embodiment, executed in the printing apparatus 1 will be described. Note that in the following description, the determining process according to the second embodiment is referred to as a second determining process. FIG. 11 is a flowchart illustrating detailed process procedure of the second determining process.

The second determining process is different from the first determining process in that a threshold for executing the first wiping process and a threshold for executing the second wiping process are set for the dot count value. Specifically, the second determining process has a threshold for determining whether attached ink has solidified and a threshold for determining whether the ejection opening surface 8*a* is wet to the extent that the ejection performance of the ejection openings 1006 degrades.

When the second determining process starts, first the print controller 202 determines whether the dot count value has reached a second count value (S1102). At this S1102, it is determined whether there is a printing element substrate 80*a* the dot count value of which has reached the second count value. The second count value is a smaller value than the above first count value and is a value with which a certain amount or more of ink is presumed to have been attached to the ejection opening surface 8*a* due to rebounding from print media S or other reasons. The certain amount is defined, for example, as an amount that does not affect the ink ejection performance of the ejection openings 1006 and with which the wiping process does not degrade the effectiveness of operation in the printing process to a certain extent or more. This second count value also varies depending on the kind of ink, the kind of print media, and other factors, and hence, the second count value is determined experimentally and set appropriately.

At S1102, if it is determined that the dot count value has not reached the second count value, in other words, if it is determined that there is no printing element substrate 80*a* the dot count value of which has reached the second count value, the process at S1102 is performed again. In other words, in the second determining process, the process in S1102 is executed repeatedly until it is determined that the dot count value has reached the second count value, or specifically, until it is determined that there is a printing element substrate 80*a* the dot count value of which has reached the second count value.

If it is determined at S1102 that the dot count value has reached the second count value, it is determined whether the highest reached temperature Tmax of the printing element substrate 80*a* the dot count value of which is determined to have reached the second count value is larger than or equal to the set temperature T (S1104). Note that in this determination process, it is determined as in the above S904 whether the ink attached to the ejection opening surface 8*a* (the surface of the printing element substrate 80*a* that faces print media S) has solidified.

If it is determined at S1104 that the highest reached temperature Tmax is higher than or equal to the set temperature T, the second wiping process is executed (S1106), and the dot count value and the highest reached temperature Tmax are initialized (S1108). After that, it is determined whether the printing process has finished (S1110). If it is determined that the printing process has not finished, the process returns to S1102, and if it is determined that the printing process has finished, this second determining process ends.

If it is determined at S1104 that the highest reached temperature Tmax is lower than the set temperature T, it is determined whether the dot count value has reached the first count value (S1112). This S1112 is for determining whether ink is attached the ejection opening surface 8*a* to the extent that the ejection performance of the ejection openings 1006 degrades. If it is determined at S1112 that the dot count value has not reached the first count value, it is determined that ink is not attached to the ejection opening surface 8*a* to the extent that the ejection performance of the ejection openings 1006 degrades, and the process returns to S1102. If it is determined at S1112 that the dot count value has reached the first count value, it is determined that ink is attached to the ejection opening surface 8*a* to the extent that the ejection performance of the ejection openings 1006 degrades, the first wiping process is executed (S1114), and the process proceeds to S1108.

As has been described above, in the determining process according to the second embodiment, in the case where the highest reached temperature Tmax of the printing element substrate 80*a* the dot count value of which has reached the second count value, which is smaller than the first count value, is higher than or equal to the set temperature T, the second wiping process is executed. For the printing element substrate 80*a* in which the highest reached temperature Tmax is lower than the set temperature T and the dot count value of which has reached the first count value, the first wiping process is executed. As described above, in the determining process of the second embodiment, it is determined whether the highest reached temperature Tmax has reached the set temperature T, at an earlier time than in the determining process of the first embodiment. Thus, the determining process according to the second embodiment provides, in addition to the effect provided in the determining process of the first embodiment, the effect of maintaining and recovering the ink ejection performance reliably even for the ink easy to solidify under the influence of temperature.

Third Embodiment

Figure 12:
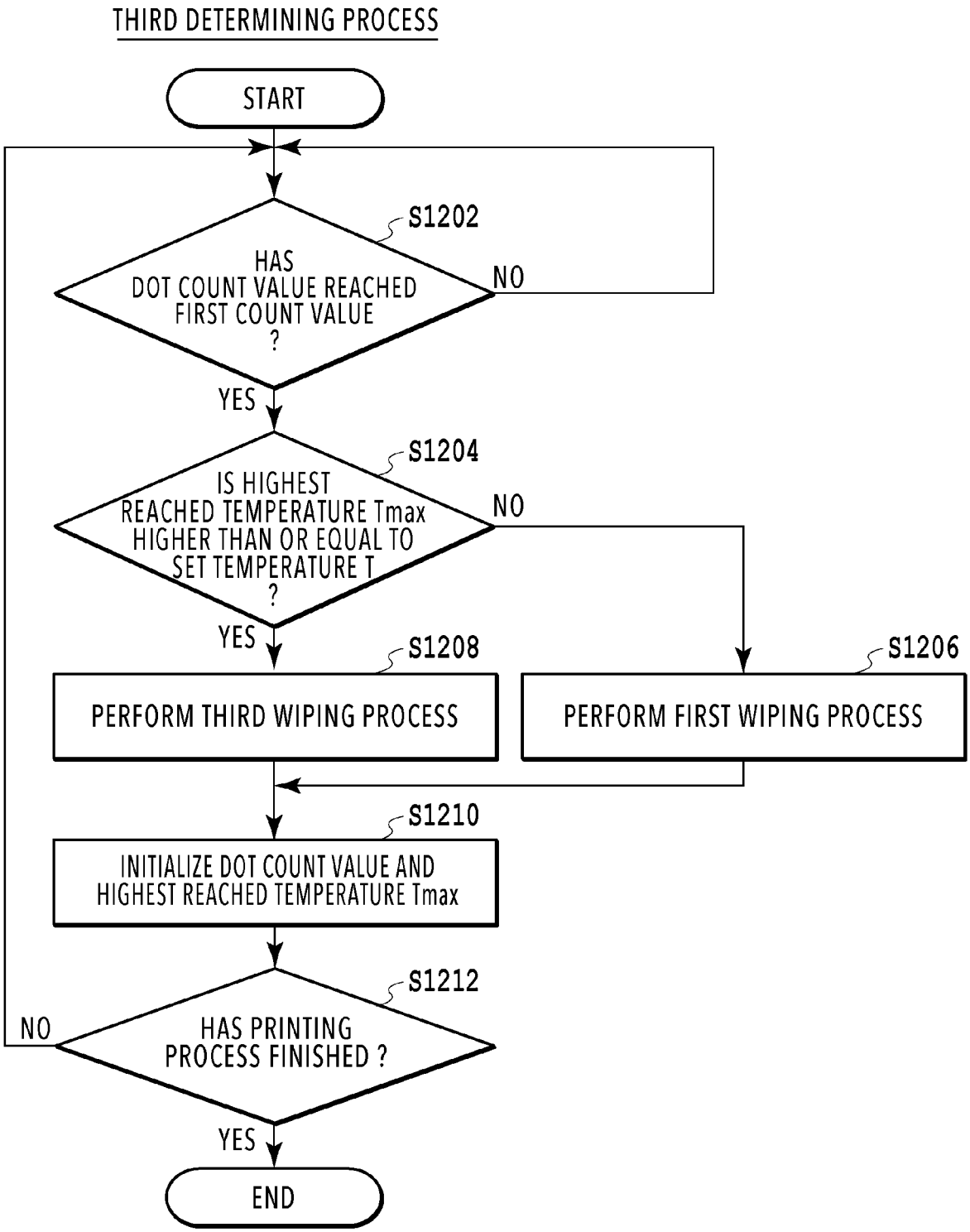
FIG. 12 is a flowchart illustrating detailed process procedure of a third determining process.

Next, a determining process according to a third embodiment, executed in the printing apparatus 1 will be described. Note that in the following description, the determining process according to the third embodiment is referred to as a third determining process. FIG. 12 is a flowchart illustrating detailed process procedure of the third determining process.

The third determining process is different from the first determining process in that instead of the second wiping process in which suction wiping is performed after blade wiping, a third wiping process is performed in which pressurization wiping is performed after blade wiping. Note that the pressurization wiping is a process in which the ink supply unit 15 is controlled such that it pressurizes the ink within the circulation route, ink is thereby discharged from each ejection opening 1006 such that the ink remains on the ejection opening surface 8*a*, and then wiping is performed with the blade wipers 171*a*. In this process, wiping is performed, dissolving the ink solidified on the ejection opening surface 8*a* using the ink discharged from the ejection openings 1006, and thus the solidified ink can be removed from the ejection opening surface 8*a* more reliably than in the blade wiping. In the present embodiment, the ink supply unit 15 and the blade wiper unit 171 function as a wiping unit that has better performance of removing ink from the ejection opening surface 8*a* and provides a higher cleaning effect than wiping only with the blade wiper unit 171.

When the third determining process starts, first it is determined whether the dot count value has reached the first count value (S1202). If it is determined that the dot count value has reached the first count value, it is determined whether the highest reached temperature Tmax is higher than or equal to the set temperature T (S1204). Then, if it is determined at S1204 that the highest reached temperature Tmax is lower than the set temperature T, the first wiping process is executed (S1206). Note that concrete process procedures from S1202 to S1206 are the same as those from S902 to S906.

If it is determined at S1204 that the highest reached temperature Tmax is higher than or equal to the set temperature T, a third wiping process is executed in which pressurization wiping is performed after blade wiping (S1208). Note that the third wiping process at S1208 will be described later.

When the wiping process is executed, the dot count value and the highest reached temperature Tmax are initialized (S1210), and it is determined whether the printing process has finished (S1212). If it is determined at S1212 that the printing process has finished, this third determining process ends. Note that concrete process procedures in S1210 and S1212 are the same as those in S910 and S912.

Figure 13:
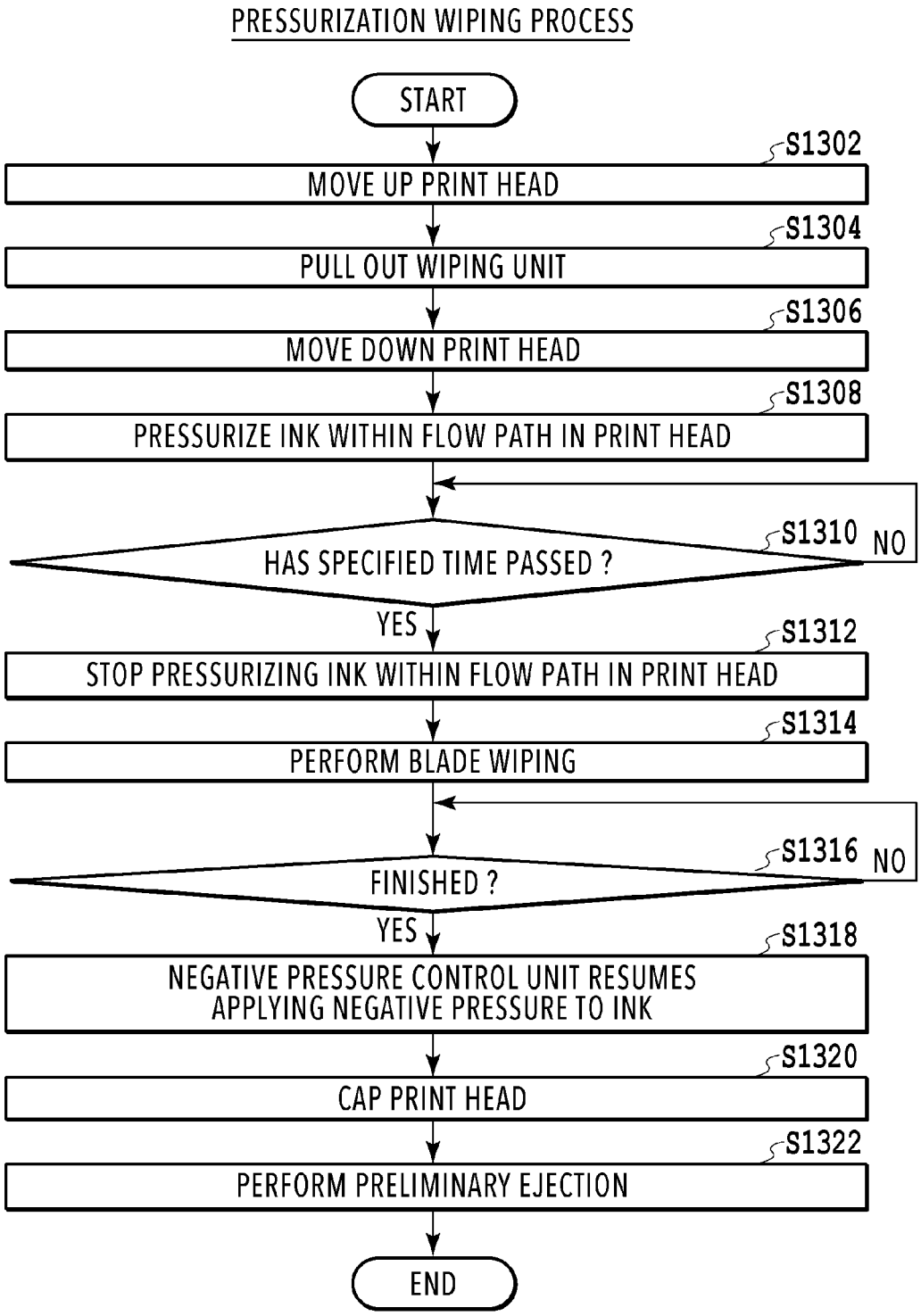
FIG. 13 is a flowchart illustrating detailed process procedure of a pressurization wiping process.

As described above, in the third wiping process, pressurization wiping is executed after blade wiping. Here, a pressurization wiping process for executing pressurization wiping will be described with reference to FIG. 13. FIG. 13 is a flowchart illustrating detailed process procedure of the pressurization wiping process.

When the pressurization wiping process starts after blade wiping finished, first the print controller 202 retreats the print head 8 to a position higher in the vertical direction than the wiping position illustrated in FIG. 4 (S1302). Next, the print controller 202 slides and pulls out the wiping unit 17 housed in the maintenance unit 16 to the blade-wiping start position (S1304). Note that the blade-wiping start position is a position at which movement of the wiping unit 17 in the −x-direction enables the blade wipers 171*a* to perform wiping on the ejection opening surface 8*a* of the print head 8 moved down to a position where the ejection opening surface 8*a* can comes into contact with the blade wipers 171*a*. Note that the −x-direction is a direction in which the wiping unit 17 is moved to be housed in the maintenance unit 16.

After that, the print controller 202 moves down the print head 8 in the vertical direction to a position where the ejection opening surface 8*a* can come into contact with the blade wipers 171*a* of the wiping unit 17 moving in the −x-direction (S1306).

After the print head 8 is moved down, next the ink within the flow path in the print head 8 is pressurized (S1308).

Specifically, at S1308, first the print controller 202, via the ink supply control unit 209, opens the supply valve V2 and closes the collection valve V4 and the head replacement valve V5. Next the print controller 202 drives the supply pump P1 and opens the pressure adjustment valves of the first negative pressure control unit 81 and the second negative pressure control unit 82 so that each negative pressure control unit will not apply negative pressure to ink. Note that the first negative pressure control unit 81 and the second negative pressure control unit 82 each have its the pressure adjustment valve. In the state where ink is not being circulated, the pressure adjustment valve of each negative pressure control unit is closed, and hence negative pressure is applied to the ink. At S1308, at the time when the print controller 202 starts driving the supply pump P1, the print controller 202 starts counting the driving time of the supply pump P1.

After that, it is determined whether a specified time has passed since the ink pressurization started (S1310). Specifically, at S1310, it is determined whether the count value that started at S1308 has reached the specified time set in advance. Here, in the case where the ink within the flow path in the ink ejection part 80 of the print head 8 is pressurized, the pressurized ink is discharged through each ejection opening 1006. Hence, the degree of pressurization to the ink at this time, in other words, the degree of driving of the supply pump P1 varies the amount of ink discharged through each ejection opening 1006. In the present embodiment, driving time of the supply pump P1 is measured at S1310 to determine the degree of driving of the supply pump P1.

Figure 14A:
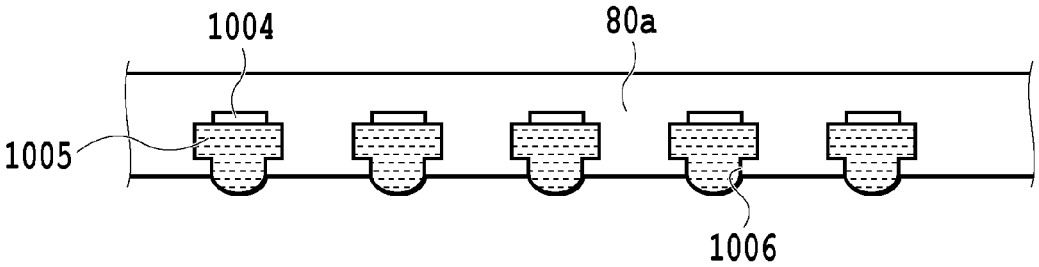
FIGS. 14A, 14B and 14C are diagrams for explaining ink discharged from ejection openings in the pressurization wiping process.
Figure 14B:
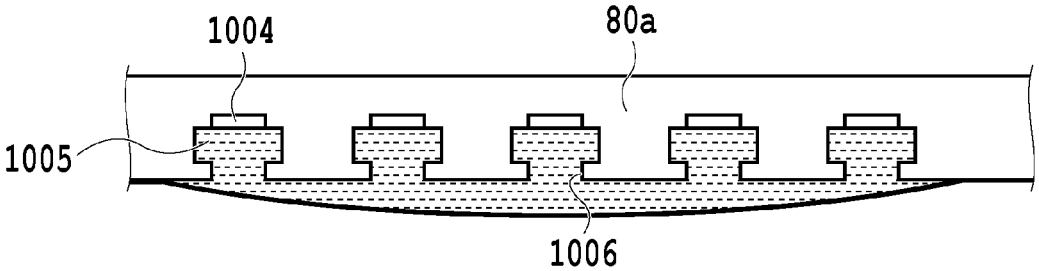
Figure 14C:
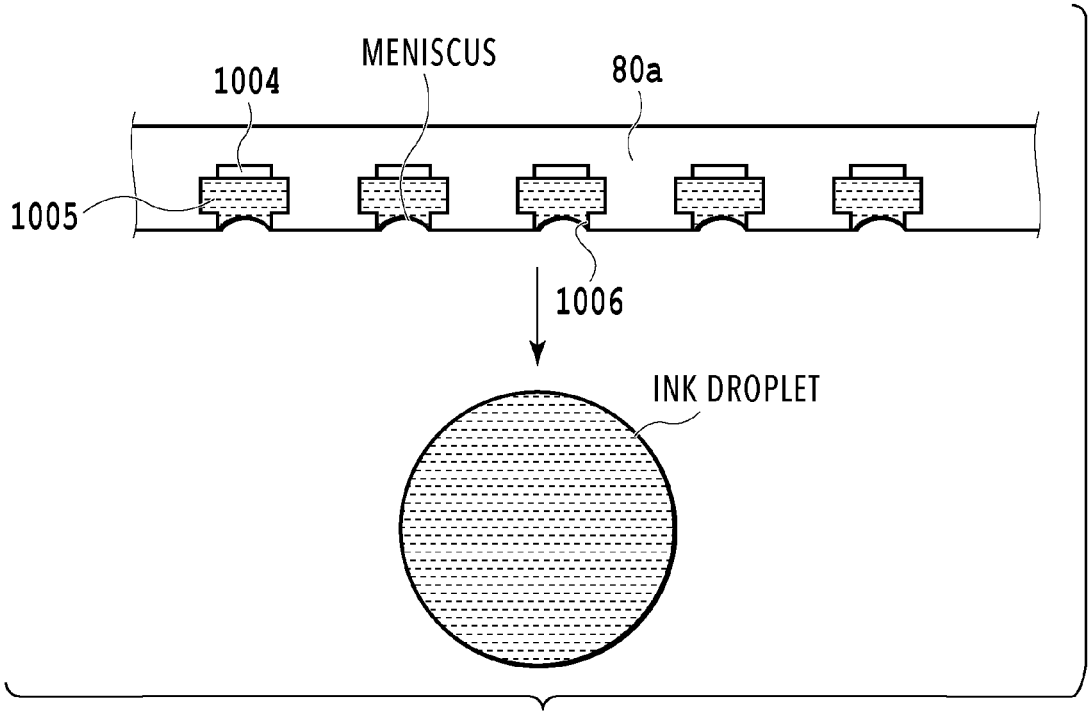

FIG. 14A is a diagram illustrating a state in which ink is being discharged through the ejection openings 1006 by pressurization. FIG. 14B is a diagram illustrating a state in which the discharged ink remains on the ejection opening surface 8*a*. FIG. 14C is a diagram illustrating a state in which the discharged ink has moved apart from the ejection opening surface 8*a*.

When the supply pump P1 is driven to pressurize the ink within the flow path, a meniscus formed at each ejection opening 1006 protrudes outward as illustrated in FIG. 14A. In the case where wiping operation using the blade wipers 171*a* is performed in this state, the ink protruding from the ejection opening surface 8*a* is wiped off with the blade wipers 171*a*, and thus wiping is performed on the ejection opening surface 8*a* with the ink attached on the blade wipers 171*a*. Hence, the ink solidified or thicken on the ejection opening surface 8*a* is dissolved by the wiped-off ink and then wiped off. In the present embodiment, the wiping operation performed using the blade wipers 171*a* in the state where the ink within the flow path of the print head 8 is pressurized and the ink is discharged through the ejection openings as described above is referred to as a pressurization wiping.

In the case where the ink is further pressurized from the state in FIG. 14A, pieces of ink discharged through the ejection openings 1006 join on the ejection opening surface 8*a* and form an ink accumulation on the ejection opening surface 8*a* as in FIG. 14B. This ink accumulation is held on the ejection opening surface 8*a* without falling off the ejection opening surface 8*a* because of the wettability of the ejection opening surface 8*a*. In the case where the ink is further pressurized from the state in FIG. 14B, the ink accumulation grows, which exceeds the amount that can be held by the wettability of the ejection opening surface 8*a*, and the ink accumulation falls as an ink droplet as in FIG. 14C. Each ejection opening 1006 after the ink droplet falls has a meniscus shape recessed into the ejection opening, and hence discharged ink does not remain on the ejection opening surface 8*a*.

In the case where wiping operation using the blade wipers 171*a* is performed in the state illustrated in FIG. 14B, the discharged ink dissolves ink solidified or thickened on the ejection opening surface 8*a* in the same way as in the case of wiping in the state illustrated in FIG. 14A. In this case, the amount of discharged ink is larger in FIG. 14B than in FIG. 14A, and hence ink solidified and thickened on the ejection opening surface 8*a* can be dissolved more reliably, increasing the cleaning effect of the blade wipers 171*a*.

Hence, the degree of driving of the supply pump P1 is set between the degree of driving at which the meniscus formed at each ejection opening 1006 protrudes outward and the degree of driving until the time just before the ink discharged from the ejection openings 1006 falls off as illustrated in FIG. 14C. It is preferable that the degree of driving of the supply pump P1 be a degree of driving at which the ink discharged through each ejection opening 1006 forms an ink accumulation on the ejection opening surface 8*a* as illustrated in FIG. 14B, but this ink accumulation does not fall off.

A driving time of the supply pump P1 set based on the degree of driving of the supply pump P1 as above is set in the print controller 202. In the present embodiment, for example, the driving time of the supply pump P1 as above is set to 3 seconds.

If it is determined at S1310 that the specified time has passed since the start of ink pressurization, the pressurization of ink is stopped (S1312), and blade wiping is performed (S1314). Specifically, at S1312, the print controller 202 stops driving the supply pump P1. At S1314, the wiping unit 17 is moved in the −x-direction to be pulled back into the maintenance unit 16. In blade wiping at S1314, ink solidified and thickened on the ejection opening surface 8*a* is dissolved by the ink discharged through the ejection openings 1006 and wiped off. Thus, solidified and thickened ink can be removed more reliably than in blade wiping performed in the state in which ink is not discharged through the ejection openings 1006.

Next, it is determined whether the blade wiping has finished (S1316). If it is determined that blade wiping has finished, the pressure adjustment valves of the first negative pressure control unit 81 and the second negative pressure control unit 82 are closed, and thereby negative pressure is applied to the ink (S1318). Specifically, at S1316, for example, it is determined whether the wiping unit 17 moved and is now housed in the maintenance unit 16, for example, based on the positional information in the x-direction on the wiping unit 17. Note that the positional information on the wiping unit 17 is obtained, for example, with a unit (an encoder or the like) provided at the driving mechanism of the wiping unit 17 and capable of obtaining the positional information.

After that, the print controller 202 moves the cap unit 10 upward in the vertical direction to bring the cap member 10*a* into close contact with the ejection opening surface 8*a* of the print head 8 (S1320). Then, the print controller 202 drives the print head 8 to perform preliminary ejection for ejecting ink that does not contribute to image printing (S1322) and then ends the pressurization wiping process. Note that at S1322, ink collected in the cap member 10*a* is sucked using the suction pump after the preliminary ejection.

As has been described above, in the determining process according to the third embodiment, in the case where the highest reached temperature Tmax of the printing element substrate 80*a* the dot count value of which has reached the first count value is higher than or equal to the set temperature T, the third wiping process is executed for performing pressurization wiping. The printing apparatus 1 thereby provides the same operational advantage as in the case of performing the determining process according to the first embodiment.

Other Embodiments

Note that the above embodiments may be modified as shown in the following (1) to (9).

(1) Although in the above embodiments, suction wiping is performed after blade wiping in the second wiping process, the present disclosure is not limited to this operation. Specifically, the second wiping process may only include suction wiping. In addition, although pressurization wiping is performed after blade wiping in the third wiping process, the present disclosure is not limited to this operation. Specifically, the third wiping process may only include pressurization wiping.

(2) In the second determining process in the above embodiments, in the case where the highest reached temperature Tmax becomes higher than or equal to the set temperature T, and hence there is high possibility that attached ink has been solidified, the second wiping process is executed. However the present disclosure is not limited to this operation. Specifically, the third wiping process may be performed instead of the second wiping process.

(3) Although in the above third embodiment, pressurization wiping is performed by pressurizing the ink within the flow path in the print head 8 to discharge ink through the ejection openings 1006 and then performing blade wiping, the present disclosure is not limited to this operation. Specifically, after ink is discharged from the ejection openings 1006, suction wiping may be performed. Solidified and thickened ink can be thereby removed more reliably.

(4) Although in the above embodiments, in the case where the highest reached temperature Tmax of a printing element substrate 80*a* becomes higher than or equal to the set temperature T, the second wiping process or the third wiping process is performed, the present disclosure is not limited to this operation. Specifically, a configuration may be possible in which it is determined whether the number of times when the temperature exceeds a specified temperature is larger than or equal to a specified number (specified value) in the temperature history of the printing element substrate 80*a*, and in the case the number of times when the temperature exceeds the specified temperature is larger than or equal to the specified number, the second wiping process or the third wiping process is performed. Alternatively, it may be determined whether the average temperature within the temperature history is larger than or equal to, for example, a first temperature which is a specified value, and in the case where the average temperature is larger than or equal to the first temperature, the second wiping process or the third wiping process may be executed.

(5) Although in the above embodiments, the determination process on the highest reached temperature Tmax is performed after the determination process on the dot count value, the present disclosure is not limited to this operation. Specifically, the determination process on the highest reached temperature Tmax may be executed after the determination process based on the time that has passed since the latest wiping process or the time that has passed since the protection of the ejection opening surface 8*a* with the cap unit 10 was removed.

To be more specific, in the determination process based on the time that has passed since the latest wiping process, it is determined whether the time elapsed since the latest (last) wiping process has reached a first time (a specified time). In this determination process, in the case where it is determined that the time elapsed since the latest wiping process has reached the first time, the determination process on the highest reached temperature Tmax is performed.

For the determination process based on the time that has passed since the protection for the ejection opening surface 8*a* with the cap unit 10, the protective member for the ejection opening surface, was removed, it is determined whether the time elapsed since the protection for the ejection opening surface 8*a* with the cap unit 10 was removed has reached a second time (a specified time). In this determination process, in the case where it is determined that the time elapsed since the protection for the ejection opening surface 8*a* with the cap unit 10 was removed has reached the second time, the determination process on the highest reached temperature Tmax is performed.

(6) In suction wiping in the above embodiments, the vacuum wiper 172*c* is moved relative to the ejection opening surface 8*a*. In addition, the wiping unit 17 is pulled out of the maintenance unit 16 and the print head 8 is moved to the wiping position to bring the vacuum wiper 172*c* into contact with the ejection opening surface 8*a*. However, the relation between the movements of the print head 8 and the vacuum wiper 172*c* is not limited to the above operation. In other words, any configuration may be possible as long as the print head 8 and the vacuum wiper 172*c* can move relative to each other.

(7) Although in the above embodiment, the printing apparatus 1 performs printing on conveyed print media, the present disclosure is not limited to this configuration. Specifically, the printing apparatus 1 may have a configuration in which printing is performed by ejecting ink from the print head onto a print medium placed at a specified position. Although in the above embodiment, suction wiping is performed only while the vacuum wiper 172*c* is moving in the forward direction, the present disclosure is not limited to this operation. Specifically, suction wiping may be performed only while the vacuum wiper 172*c* is moving in the backward direction or while it is moving in both in the forward direction and in the backward direction.

(8) Although in the above embodiments, it is determined whether the highest reached temperature Tmax of the printing element substrate 80*a* the dot count value of which is determined to have reached a set count value is higher than or equal to the set temperature T, the present disclosure is not limited to this operation. Specifically, the determination process on the dot count value may be eliminated, and it may be determined whether there is a printing element substrate 80*a* the highest reached temperature Tmax of which is higher than or equal to a set temperature. In this case, if it is determined that there is a printing element substrate 80*a* matching the criterion, the second wiping process or the third wiping process is executed, and if it is determined that there is no printing element substrate 80*a* matching the criterion, the first wiping process is executed.

(9) Although in the above embodiments, the ejection opening array is formed on the ejection opening surface 8*a* by arraying multiple printing element substrates 80*a*, each having multiple arrayed ejection openings, on the ejection opening surface 8*a*, the present disclosure is not limited to this configuration. Specifically, a single printing element substrate may be used to form the ejection opening array on the ejection opening surface 8*a*. In the above first embodiment and second embodiment, the configuration of the printing apparatus 1 may not include a mechanism to circulate ink. In the above third embodiment, the configuration of the printing apparatus 1 may not include a vacuum wiper unit 172.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189658 filed Oct. 5, 2018, which is hereby incorporated by reference wherein in its entirety.

What is claimed is:

1. An inkjet printing apparatus comprising:

a printing unit including a member provided with ejection opening surface formed on arrayed multiple ejection openings configured to perform printing by ejecting ink from the ejection openings;

a wiping unit configured to wipe the ejection opening surface using wiping member and further configured to perform first wiping in which wiping is performed on the ejection opening surface and to perform second wiping having higher performance of removing ink from the ejection opening surface than the first wiping;

an obtaining unit configured to obtain information on a temperature of the ejection opening surface;

a control unit configured to control the wiping unit based on the information obtained by the obtaining unit such that in a case where a value indicated by the information is less than a specified value, the control unit causes the wiping unit to perform the first wiping, and in a case where the value indicated by the information is the specified value or more, the control unit causes the wiping unit to perform the second wiping.

2. The inkjet printing apparatus according to claim 1, wherein after the number of ink ejections from the ejection openings has reached a set value, the control unit, based on the information, causes the wiping unit to perform the first wiping or to perform the second wiping.

3. The inkjet printing apparatus according to claim 2, wherein the print unit comprising multiple substrates, each having a certain number of the ejection openings arrayed on an ejection opening surface, the obtaining unit obtains the information for each of the substrates, and the control unit causes the wiping unit to perform the first wiping or causes the wiping unit to perform the second wiping, based on the information on the substrate in which the number of ink ejections from the ejection openings has reached the set value.

4. The inkjet printing apparatus according to claim 1, wherein in a case where the number of ink ejections from the ejection openings reached a second value which is smaller than a first value for causing the wiping unit to perform the first wiping, and the value indicated by the information is the specified value or more, the control unit causes the wiping unit to perform the second wiping, and in a case where the value indicated by the information is less than the specified value, and the number of ink ejections from the ejection openings has reached the first value, the control unit causes the wiping unit to perform the first wiping.

5. The inkjet printing apparatus according to claim 1, wherein after the time elapsed since the latest wiping operation has reached a specified time, the control unit, based on the information, causes the wiping unit to perform the first wiping or causes the wiping unit to perform the second wiping.

6. The inkjet printing apparatus according to claim 1, further comprising a protective member configured to protect the ejection opening surface of the printing unit, wherein after the time elapsed since removing protection for the ejection opening surface by the protective member has reached a specified time, the control unit, based on the information, causes the wiping unit perform the first wiping or causes the wiping unit perform the second wiping.

7. The inkjet printing apparatus according to claim 1, wherein the value indicated by the information is the number of times when the temperature exceeded a specified temperature in a temperature history obtained by the obtaining unit.

8. The inkjet printing apparatus according to claim 1, wherein the value indicated by the information is the highest temperature in a temperature history obtained by the obtaining unit.

9. The inkjet printing apparatus according to claim 1, wherein the value indicated by the information is the average temperature in a temperature history obtained by the obtaining unit.

10. The inkjet printing apparatus according to claim 1, wherein the wiping unit performs the second wiping by sucking the ejection opening surface.

11. The inkjet printing apparatus according to claim 1, wherein the wiping unit performs the second wiping to the ejection opening surface while the print unit discharges ink from the ejection openings of the ejection opening surface.

12. The inkjet printing apparatus according to claim 1, wherein the second wiping is sucking the ejection opening surface.

13. The inkjet printing apparatus according to claim 1, wherein the second wiping is wiping the ejection opening surface while the print unit discharges ink from the ejection openings of the ejection opening surface.

14. A recovery method used in an inkjet printing apparatus including a printing unit provided with an ejection opening surface formed on arrayed multiple ejection openings and configured to perform printing by ejecting ink from the arrayed multiple ejection openings, the recovery method being for maintaining and recovering ejection performance of the ejection openings comprising: a obtaining step of obtaining information on a temperature of the ejection opening surface, and a wiping step of wiping the ejection opening surface based on the information obtained in the obtaining, in a case where a value indicated by the information is less than a specified value, the first wiping is performed, and in a case where the value indicated by the information is the specified value or more, the second wiping having higher performance of removing ink from the ejection opening surface than the first wiping.

15. The recovery method according to claim 14, wherein in the wiping step, in a case where the number of ink ejections from the ejection openings has reached a set value, the first wiping or the second wiping is performed based on the information.

16. The recovery method according to claim 14, wherein in the wiping step, in a case where the number of ink ejections from the ejection openings has reached a second value which is smaller than a first value for performing the first wiping, and the value indicated by the information is the specified value or more, the second wiping is performed, and in a case where the value indicated by the information is less than the specified value, and the number of ink ejections from the ejection openings has reached the first value, the first wiping is performed.

17. The recovery method according to claim 14, wherein in the wiping step, after the time elapsed since the latest wiping operation has reached a specified time, the first wiping or the second wiping is performed based on the information.

18. The recovery method according to claim 14, wherein in the wiping step, after the time elapsed since removing protection for the ejection opening surface by a protective member has reached a specified time, the first wiping or the second wiping is performed based on the information.

19. The recovery method according to claim 14, wherein the value indicated by the information is the number of times when the temperature exceeded a specified temperature in a temperature history obtained in the obtaining.

20. The recovery method according to claim 14, wherein the value indicated by the information is the highest temperature in a temperature history obtained in the obtaining.

21. The recovery method according to claim 14, wherein the value indicated by the information is the average temperature in a temperature history obtained in the obtaining.

* * * * *